US008307912B2

(12) United States Patent
Fisher

(10) Patent No.: US 8,307,912 B2
(45) Date of Patent: Nov. 13, 2012

(54) TOOL

(76) Inventor: Hugh Edward Fisher, Dalrymple (GB)

( * ) Notice: Subject to any disclaimer, the term of this patent is extended or adjusted under 35 U.S.C. 154(b) by 365 days.

(21) Appl. No.: 12/675,551

(22) PCT Filed: Aug. 28, 2008

(86) PCT No.: PCT/GB2008/002910

§ 371 (c)(1),
(2), (4) Date: May 11, 2010

(87) PCT Pub. No.: WO2009/027678

PCT Pub. Date: Mar. 5, 2009

(65) Prior Publication Data

US 2010/0300719 A1 Dec. 2, 2010

(30) Foreign Application Priority Data

Aug. 30, 2007 (GB) ..... 0716849.5

(51) Int. Cl.
*B25D 15/02* (2006.01)
*B63B 59/08* (2006.01)

(52) U.S. Cl. ..... 173/205; 173/109; 173/128; 30/272.1

(58) Field of Classification Search ..... 173/109, 173/128, 205, 104, 122, 124; 92/71, 12.2; 74/55; 408/20; 606/82; 30/272.1, 182
See application file for complete search history.

(56) References Cited

U.S. PATENT DOCUMENTS

| | | | | |
|---|---|---|---|---|
| 1,505,493 | A * | 8/1924 | Roberts | 173/205 |
| 3,667,876 | A | 6/1972 | Boyd | |
| 5,036,809 | A * | 8/1991 | Goodman | 123/241 |
| 5,427,188 | A * | 6/1995 | Fisher | 173/205 |
| 5,513,709 | A * | 5/1996 | Fisher | 173/205 |
| 5,607,265 | A * | 3/1997 | Lane | 408/20 |
| 6,007,541 | A * | 12/1999 | Scott | 606/82 |
| 6,199,640 | B1 * | 3/2001 | Hecht | 173/48 |
| 6,368,324 | B1 * | 4/2002 | Dinger et al. | 606/85 |
| 6,814,153 | B2 * | 11/2004 | Hecht et al. | 173/47 |
| 7,299,740 | B2 * | 11/2007 | Adams | 92/71 |
| 7,743,847 | B2 * | 6/2010 | Fisher | 173/205 |
| 7,765,631 | B2 * | 8/2010 | Fisher | 15/93.1 |

FOREIGN PATENT DOCUMENTS

| | | |
|---|---|---|
| EP | 1635059 | 3/2006 |
| GB | 2219958 | 8/2001 |
| WO | WO93 11910 | 6/1993 |
| WO | WO-99 19646 | 4/1999 |
| WO | WO 0214028 | 2/2002 |

* cited by examiner

*Primary Examiner* — Scott A. Smith
(74) *Attorney, Agent, or Firm* — Gifford, Krass, Sprinkle, Anderson & Citkowski, P.C.

(57) ABSTRACT

Disclosed is a tool (5) comprising a cam track (A) and cam follower (B), wherein the cam track (A) comprises a first cam track wall (15) and the cam follower (B) comprises a first cam follower wall (15), and the first cam track wall (10) and first cam follower wall (15) face one another. The cam track (A) further comprises a second cam track wall (30) and the cam follower (B) comprise a second cam follower wall (35), and the second cam track wall (30) and second cam follower wall (35) face one another. The first and second cam track wall (10, 30) are disposed so as to face one another. The first and second cam follower wall are disposed so as to oppose one another, e.g. back to back. The first/second cam track wall (10, 30) comprise a first/second cam track wave (20, 40). The second cam follower wall (15, 35) comprise a first/second cam follower wave (25, 45).

70 Claims, 20 Drawing Sheets

WF

1

DRILL

SK5-1

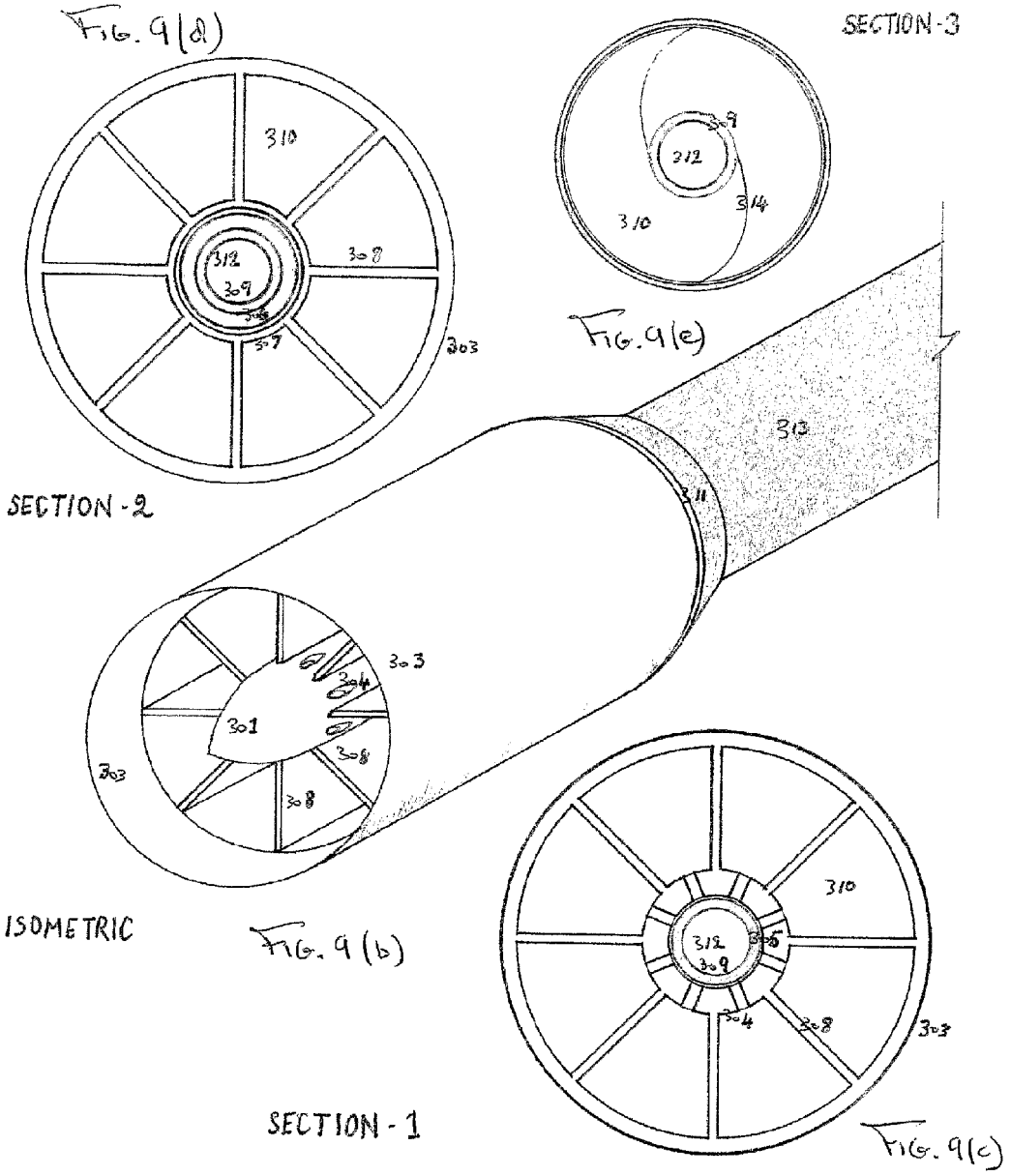
DRILL
SK5-2

CAM GEAR CONTAINMENT POD

DRIVE SHAFT AND CAM ENGAGEMENT WAVES

DRILL

SK5-3

DRILL SK5-5

DRILL SK5-6

DRILL SK5-7

DRILL SK5-8

FIG. 12(c)
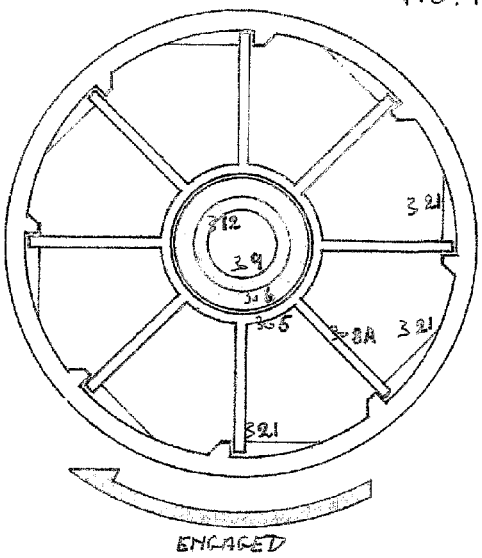
ROD SECTION AT V. L.
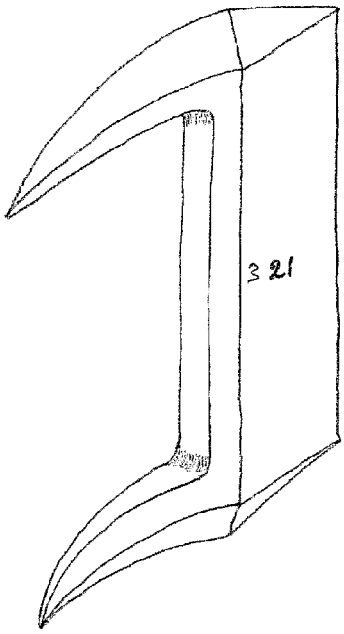
VIBRATION LOCK
FIG. 12(e)
DISENGAGED
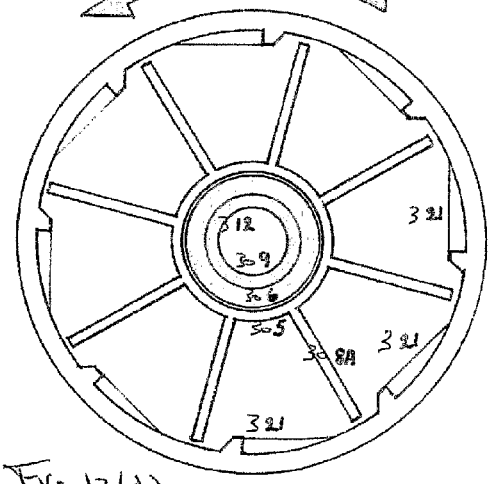
FIG. 12(d)
DRILL
SK5-9

DRILL SK5-10

DRILL SK5-11

TOOL

FIELD OF INVENTION

This invention is concerned with improvements in and relating to tools. The invention also relates to cam operated devices or cam operated power tools, and more particularly to tools or power tools with reciprocating tool bits driven by rotary drive means or tools or power tools with rotary tool bits driven by reciprocating drive means.

The invention is also concerned with power tools, particularly, though not exclusively, relatively lightweight or hand-held power tools, e.g. for the do-it-yourself (DIY) and professional/trade markets. The invention may find particular use in the marine field. The invention is also concerned with downhole tools, e.g. for use in drilling of wells or boreholes.

BACKGROUND TO INVENTION

A number of types of reciprocating power tools are in use for various tasks, e.g. scrapers, saws, hammers or the like. Commonly such tools are hydraulically or pneumatically powered; however, such powering necessitates use of a noisy and bulky compressor or the like in conjunction with the tool itself, resulting in a limited range of utility for such tools. Further, such tools cannot easily or efficiently attain high speeds of reciprocation.

An alternative arrangement is to convert rotary movement provided by, for example, an electric motor into reciprocating movement of the tool bit. One means for achieving this conversion is to use the motor to drive the rotation of a cam bearing a cam track, and to provide the tool bit with a pair of cam followers, which are a close fit within the cam track. As the cam rotates the cam followers are driven forward and backward along the cam track, which is typically a sinusoidal cam track, so driving the tool bit forward and backward. Such arrangements are described in GB 2 219 958 A and WO 93/11910 by the same Inventor, the contents of which are incorporated herein by reference.

WO 01/60564 also by the same Inventor, the content of which is incorporated herein by reference, discloses a portable power tool, such as a hand-held marine growth removal scraper tool comprising a housing, a drive means and a mounting arrangement for a tool bit, wherein there is provided within the housing an output arrangement adapted to drive an output shaft in a reciprocal axial movement to drive the tool bit, and wherein the drive means is substantially sealed from external of the tool.

WO 02/14028 also by the same Inventor, the content of which is incorporated herein by reference, discloses a power tool comprising a housing, a rotary drive means, a cylinder cam having a cam track extending around a circumferential surface thereof, cam follower means adapted to run in said cam track, and a mounting arrangement for a tool bit, one of the cam and the cam follower means being driven by the drive means, and the mounting arrangement being associated with one of the cam and the cam follower means, such that actuation of the rotary drive means drives reciprocal movement of the mounting arrangement; and wherein at least part of the cam track is in the form of a wave having an amplitude and a wavelength, the wave providing a forward throw section and a rearward throw section which in use drive the mounting arrangement respectively forward and rearward, at least one of the forward throw section or rearward throw section imparting a greater forward or rearward acceleration respectively to the mounting arrangement than that imparted by a sinusoidal cam track of equivalent amplitude and wavelength.

A number of problems have been identified in the prior art. For example, when a tool is operated in particularly robust uses, e.g. marine hull scraping, it has been found desirable to seek to provide an improved tool. This is required in order to seek to ensure appropriate efficient functionality of the tool, e.g. removal of marine debris or encrustations, preferably without damaging the underlying substrate, e.g. hull.

Further, the pair of cam followers comprise pins which, e.g. due to repeated cyclic use, may become fatigued and liable to failure.

Yet further, the pair of cam followers and cam track of the prior art are difficult to adapt to many desirable cyclic (throw/return) motions.

It is an object of at least one embodiment of at least one aspect of the present invention to obviate or at least mitigate one or more problems and/or disadvantages in the prior art.

It is an object of at least one embodiment of at least one aspect of the present invention to provide an improved tool, e.g. a power tool, hand-held power tool, and/or scraper tool, e.g. marine tool such as an anti-fouling tool.

SUMMARY OF INVENTION

One or more objects of the invention are sought to be addressed by providing a tool comprising at least one cam track and at least one respective cam follower, wherein the cam track comprises a first cam track wall and the cam follower comprises a first cam follower wall, and the first cam track all means and first cam follower wall means face one another.

According to a first aspect of the present invention there is provided a tool comprising a cam track and cam follower means, wherein the cam track comprises a first cam track wall means and the cam follower comprises a first cam follower wall means, and the first cam track wall means and first cam follower wall means face one another.

The first cam track wall means may comprise or provide a first cam follower wave or waveform.

The first cam follower wall means may comprise or provide a first cam follower wave or waveform.

In use, the first cam track wall means and first cam follower wall means may selectively abut, strike, ride over or upon, slide relative to, and/or contact one another.

In this way the first cam track wall means and first cam follower wall means may interact with, co-act or ride upon one another such that at least part of a motion of the cam track defines or determines at least part of a motion of the cam follower or vice versa.

The cam track may further comprise a second cam track wall means and the cam follower may comprise a second cam follower wall means, and the second cam track wall means and second cam follower wall means may face one another.

The first and second cam track wall means may be disposed so as to face one another.

The first and second cam follower wall means may be disposed so as to oppose one another, e.g. back to back.

In such disposition the cam follower means may be provided within the cam track, e.g. between the first and second cam track walls.

The second cam track wall means may comprise or provide a second cam track wave or waveform.

The second cam follower wall means may comprise or provide a second cam follower wave or waveform.

In use, the second cam track wall means and second cam follower wall means may selectively abut, strike, ride over or upon slide relative to and/or contact one another.

In this way the second cam track wall means and second cam follower wall means may interact with, co-act or ride upon one another such that at least a further part of a motion of the cam track defines at least a further part of a motion of the cam follower or vice versa.

The first cam track wall means may be rotationally or circumferentially continuous.

The first cam track wave may comprise a periodic waveform.

The first cam track wave may preferably comprise a sinusoidal waveform.

The second cam track wall means may be rotationally or circumferentially continuous.

The second cam track wave may comprise a periodic waveform.

The second cam track wave may preferably comprise a sinusoidal waveform.

The first cam follower wall means may be rotationally or circumferentially continuous.

Alternatively, the first cam follower wall means may be provided on a plurality of spaced cam follower members. In such case each cam follower member may define at least part of the first and/or second cam follower walls and/or waves.

The first cam follower wall means may comprise or define a periodic waveform.

The first cam follower wall means may comprise or define a sinusoidal waveform.

The second cam follower wall means may be rotationally or circumferentially continuous.

Alternatively or additionally, the second cam follower wall means may be provided on the or a further plurality of spaced cam follower members.

The second cam follower wall means may comprise or define a periodic waveform.

The second cam follower wall means may comprise or define a sinusoidal waveform.

The cam follower may comprise at least first and second parts assembled to provide a rotationally or circumferentially continuous cam follower.

A longitudinal distance between a peak of the first cam track wave and a peak of the second cam track wave may be less than a longitudinal distance between a peak of the first cam follower wave and a peak of the second cam follower wave.

In a preferred implementation a period or frequency of the first and second cam track waveforms and first and second cam follower waveforms are substantially the same.

The amplitude of the first cam track waveform and first cam follower waveform may be substantially the same.

The amplitude of the second cam track waveform and second cam follower waveform may be substantially the same.

In a preferred embodiment all of the waveforms may have the same frequency and amplitude.

Advantageously peaks of the first and second cam track waveforms are circumferentially or radially coincident or longitudinally face one another.

Advantageously troughs of the first and second cam track waveforms are circumferentially radially coincident or longitudinally face one another.

Advantageously peaks of the first and second cam follower waveforms are circumferentially or radially coincident or longitudinally oppose one another.

Advantageously troughs of the first and second cam follower waveforms are circumferentially or radially coincident or longitudinally oppose one another.

Advantageously a longitudinal distance between peaks of the first and second cam track walls is less than a longitudinal distance between peaks of the first and second cam follower walls.

Preferably the cam track is provided circumferentially on a cam cylinder.

In a preferred embodiment there may be provided rotary drive means for rotarily driving the cam track. In such instance the rotary motion of the cam track may be converted into reciprocal (longitudinal) motion of the cam follower means.

Alternatively there may be provided rotary drive means for rotarily driving the cam follower means. In such instance the rotary motion of the cam follower means may be converted into reciprocal (longitudinal) motion of the cam track.

Alternatively there may be provided reciprocal (longitudinal) drive means for reciprocally driving the cam track. In such instance the reciprocal motion of the cam track may be converted into rotary motion of the cam follower means.

Alternatively there may be provided reciprocal (longitudinal) drive means for reciprocally driving the cam follower means. In such instance the longitudinal motion of the cam follower means may be converted into rotary motion of the cam track.

The cam track/cam cylinder may be made from a metallic material, e.g. phosphor bronze.

The cam follower means may be made from a metallic material, e.g. phosphor bronze.

A width of at least a portion of the cam track may be greater than a width of at least a portion of the cam follower means. The cam follower means and cam track may therefore be a loose fit relative to one another. This is in contradistinction to the prior art wherein the cam follower means was a close or tight fit within the cam track.

Preferably the cam track and cam follower means are engaged with one another.

Preferably the cam follower means is engaged within or located in the cam track.

The cam follower means may be adapted to run in the cam track, e.g. move around the cam track and be thrown between the opposing first and second cam wall means of the cam track.

A width of at least a portion of the cam follower means may be less than 90%, 80%, 70%, 60%, or 50% of a width of at least a portion of the cam track.

The width of the cam follower means may be in the region of 10% to 90%, or 40% to 80% of the width of the at least a portion of the cam track.

In use, when not placed against a work surface (unloaded), the cam follower means may follow a path dictated substantially only by the cam track.

The cam track and cam follower means may be such that, in use, when not placed against a work surface the cam follower means travels in a path from one portion on one wall of the cam track to another portion on another wall of the cam track, preferably without intermediately striking the walls of the track.

In use, when placed against a work surface (loaded), the cam follower means may follow a path dictated by the cam track and by ricochet of the tool off the work surface and/or the cam follower means off the first and second wall means of the cam track.

In the latter case the cam follower means therefore has two degrees of motion, a first degree of motion defined by the cam track, and a second degree of motion defined by ricochet between opposing walls of the cam track.

The first degree of motion may have a frequency defined by the cam track.

The second degree of motion may have a higher frequency than the frequency of the first degree of motion. The frequency of the second degree of motion may vary dependent upon the work surface to which the tool is presented.

The first degree of motion may cause a substantially longitudinal throw of a tool bit of the tool.

The second degree of motion may cause a substantially longitudinal vibration or chatter of the tool bit of the tool.

A width of at least a portion of the cam follower means may be less than a width of at least a portion of the cam track.

The cam track may comprise a closed (circular) track, and may be provided on a cam cylinder. The width of the cam track may be constant or may vary around the length thereof.

The cam follower may comprise a closed (circular) member or members. The width of the cam follower may be constant or may vary around the length thereof.

Preferably the cam track may be recessed, and the cam follower means received therein. Alternatively the cam follower means may be recessed, and the cam track received therein.

The tool may advantageously be a power tool or hand-held tool, e.g. a hand-held power tool.

The tool may be powered by an external electrical supply, e.g. mains electricity (e.g. 110V/240V) or advantageously by a low voltage supply (e.g. 12V), e.g. from a motor vehicle or automotive vehicle or vessel/boat. The electrical supply may be alternating current (AC) or direct current (DC). The tool may be battery powered.

The cam track or the cam follower means may be rotationally driven by rotational drive means, e.g. an electric motor.

In a particularly advantageous embodiment the tool may comprise a marine growth removal or anti-fouling tool, e.g. barnacle scraper.

The tool may comprise a housing, a drive means and a mounting arrangement for a tool bit, wherein there is provided within the housing an output arrangement adapted to drive an output shaft in a reciprocal axial movement to drive the tool bit, and the drive means may be substantially sealed (e.g. against fluid ingress) from external of the tool. This arrangement allows the tool to be used underwater or in wet/moist environments.

In alternative advantageous embodiments the tool may comprise a handyman's or tradesman's tool.

The tool may comprise a scraper, paint stripper, wallpaper stripper, chisel, cold chisel, power spade, hammer or the like.

In a further alternative embodiment the tool may comprise a downhole tool.

The tool may comprise one or more of:

a housing;

a rotary drive means, e.g. electric motor;

a cylinder cam having the cam track extending around a circumferential surface thereof;

a mounting arrangement for (releasably holding) a tool bit, one of the cam track and cam follower means being driven by the drive means;

the mounting arrangement being associated with one of the cam track and the cam follower means, such that actuation of the rotary drive means drives reciprocal movement of the mounting arrangement;

at least part of the cam track being in the form of a wave having an amplitude and a wavelength, the wave having a forward throw section, and a rearward throw section, which, in use, drive the mounting arrangement respectively forward and rearward.

There may be provided a plurality of interchangeable tool bits.

According to a second aspect of the present invention there is provided a tool comprising a cam track and a cam follower means, wherein the cam track comprises at least a first cam track waveform and the cam follower comprises at least a first cam follower waveform.

Preferably, in use, movement of the cam track causes movement of the cam follower via interaction of the at least a first cam track waveform with the at least a first cam follower waveform or alternatively vice versa.

The features of the first aspect of the invention hereinbefore recited may be provided in the tool of the second aspect either separately or in combination.

BRIEF DESCRIPTION OF DRAWINGS

Embodiments of the invention will now be described by way of example only, and with reference to the accompanying drawings, which are:

FIG. 9(*b*) a perspective view of the downhole tool of FIG. 9(*a*);

FIG. 9(*c*) a sectional view through line S1 of the downhole tool of FIG. 9(*a*);

FIG. 9(*d*) a sectional view through line S1 of the downhole tool of FIG. 9(*a*);

FIG. 9(*e*) a sectional view through line S3 of the downhole tool of FIG. 9(*a*);

FIG. 9(*f*) a sectional side view of a containment pod having cam tracks of the downhole tool of FIG. 9 (*a*);

FIG. 9(*g*) a perspective view of a drive shaft having cam followers of the downhole tool of FIG. 9(*a*);

FIG. 9(*h*) a side view of the drive shaft having cam followers of FIG. 9(*g*);

FIG. 12(*b*) a sectional side view of the third modification of FIG. 12(*a*) to the downhole tool of FIG. 9(*a*) in a second disposition;

FIG. 12(*c*) a cross-sectional view of part of the downhole tool of FIG. 12(*a*) in a first disposition;

FIG. 12(*d*) a cross-sectional view of part of the downhole tool of FIG. 12(*a*) in a second disposition;

FIG. 12(*e*) a perspective view of part of the downhole tool of FIG. 12(*a*);

FIG. 13(*b*) a cross-sectional side view of the fourth modification of FIG. 13(*a*) to the downhole tool of FIG. 13(*a*) in a second disposition.

DETAILED DESCRIPTION OF DRAWINGS

Figure 1:
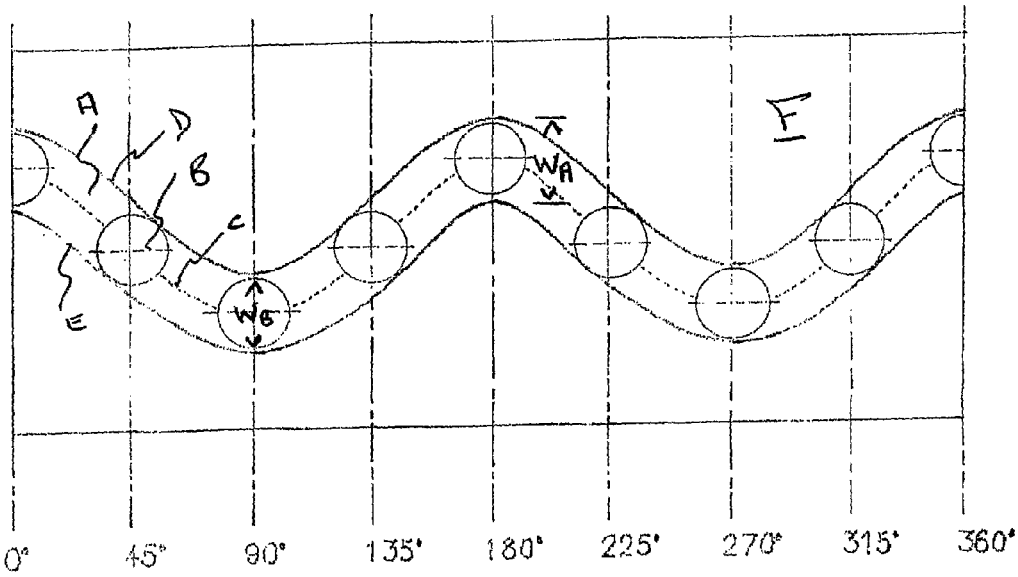
FIG. 1 a cam track and cam follower arrangement of a tool according to the prior art.

Referring initially to FIG. 1, there is shown a cam track A and cam follower means B arrangement of a tool according to the prior art. This arrangement is disclosed in the prior art by the same Inventor, as presently.

As can be seen from FIG. 1, the cam follower means B, comprising a cylindrical pin, is a snug fit in the cam track A, which is of sinusoidal form, a width $W_B$ of the cam follower means B being substantially the same as the width $W_A$ of the cam track A, such that there is little or no play between the cam follower means B and the cam track A. Thus, in use, the cam follower means B follows the track C shown, have only one degree of freedom of movement. The cam track has walls D, E.

FIG. 1 shows a parallel sided cam track A or wave or cam slot cut around a revolving cam drum F. The circular cam follower means B shown engaging the cam track A are substantially the same in diameter as the width of the cam track A. When the cam drum F revolves, the cam follower means B follows the wave shape precisely as there is no other alternative open to them. The track or path C is shown in FIG. 1 by a dotted line central to the width of the cam track A.

Although such a tool according to the prior art providing such an arrangement was found to be an improvement over the art, further improvement is desirable, particularly in using such a tool in robust uses, e.g. as a marine scraper.

Figure 2:
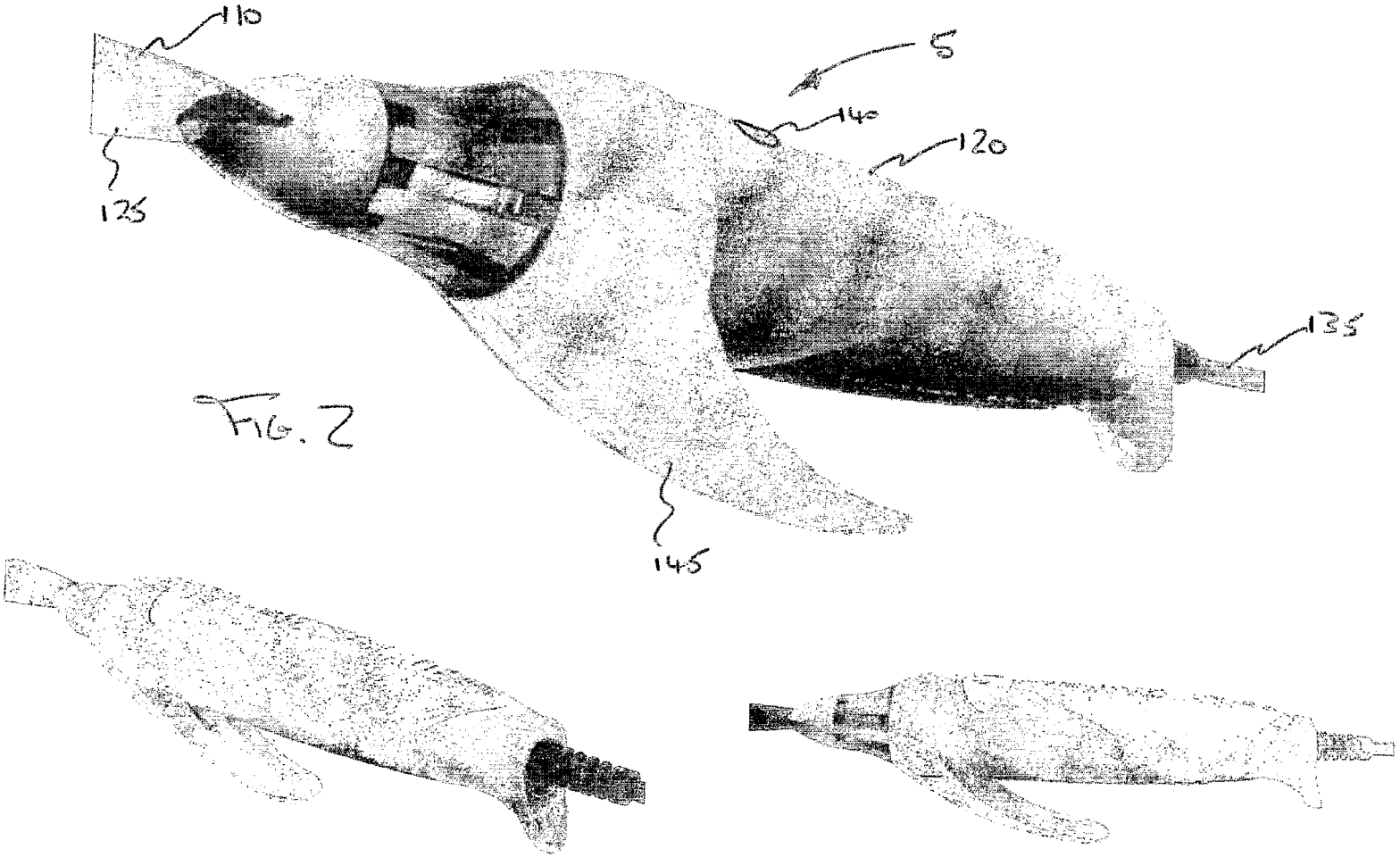
FIG. 2 a perspective view from the front and to one side of a tool according to a first embodiment of the present invention.
Figure 3:
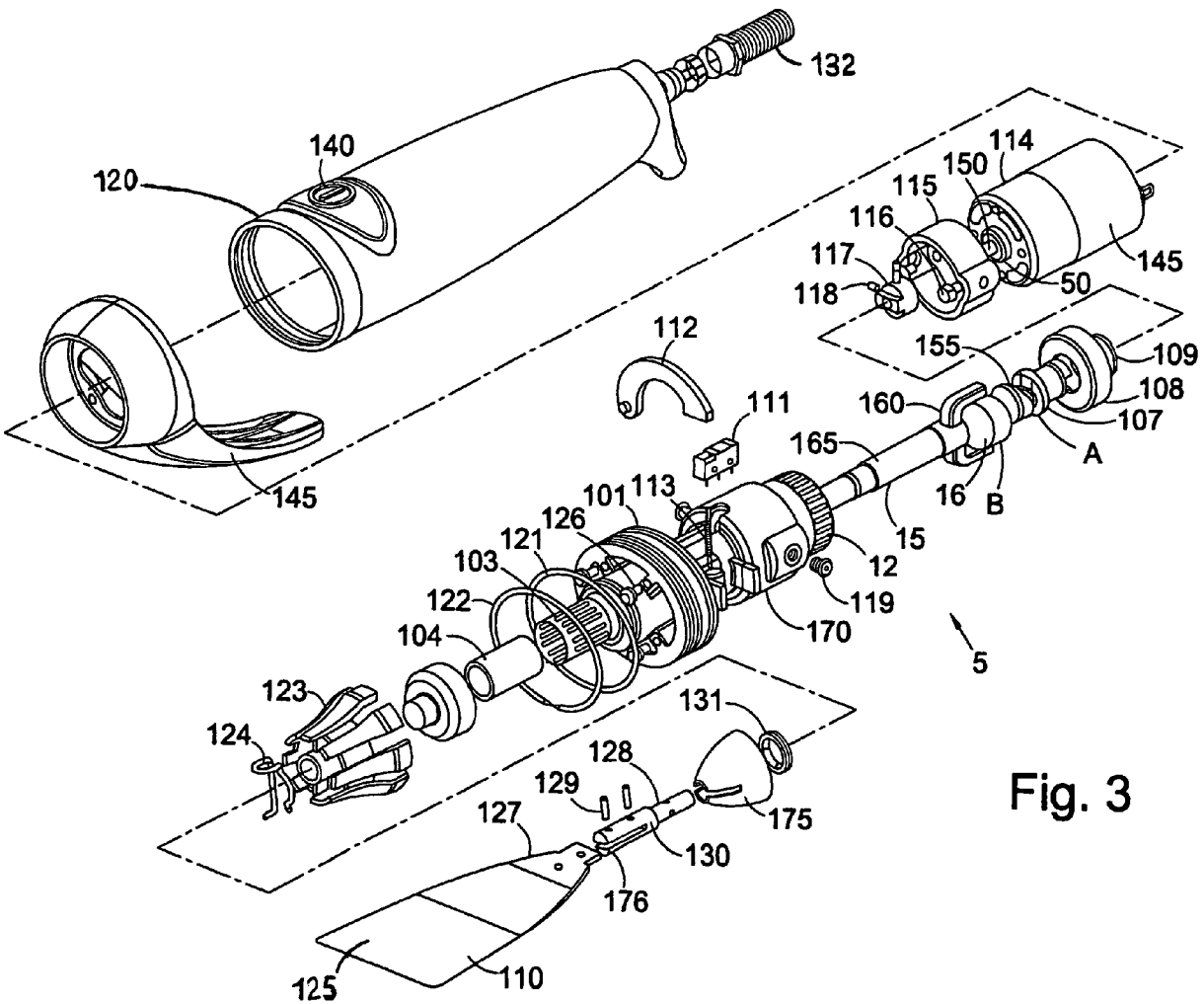
FIG. 3 an exploded perspective view from the front and to one side of the tool of FIG. 2.
Figure 4B:
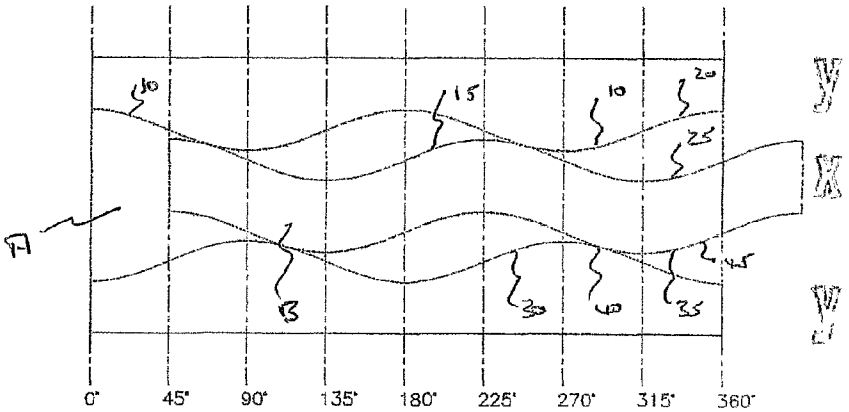
FIGS. 4(*a*) and (*b*) a cam track and cam follower arrangement comprising part of the tool of FIG. 2 in first and second positions, respectively.
Figure 4A:
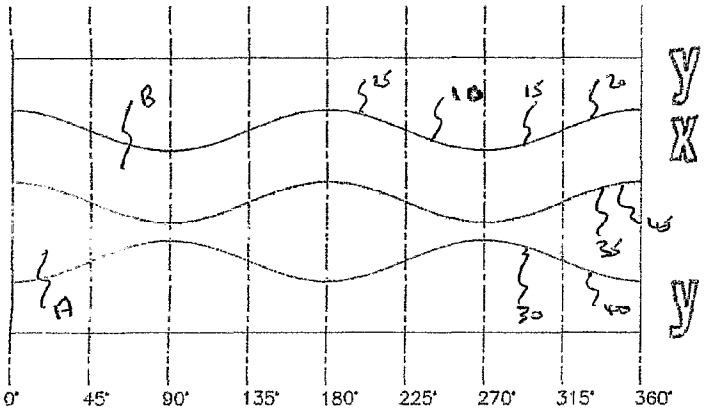

Referring now to FIGS. 2 to 4(*b*), there is shown a tool, generally designated 5, according to an embodiment of the present invention having a cam track A and cam follower B arrangement. The tool 5 comprises cam track A and cam follower B means adapted to run in the cam track A, following a path C (not shown).

The cam track A comprises a first cam track wall means 10 and the cam follower B comprises a first cam follower wall means 15, and the first cam track wall means and first cam follower wall means 15 face one another.

The first cam track wall means provides a first cam track wave or waveform 20. The first cam follower wall means provides a first cam follower wave or waveform 25. In use, the first cam track wall means 10 and first cam follower wall means 15 selectively contact, abut or slide relative to, ride upon and/or contact one another. In this way the first cam track wall means 10 and first cam follower wall means 15, in use, interact with or upon one another such that at least part of a motion (e.g. rotational motion) of the cam track A defines at least part of a motion (e.g. longitudinal motion) of the cam follower B or vice versa.

The cam track A further comprises a second cam track wall means 30, and the cam follower B comprises a second cam follower wall means 35, and the second cam track wall means 30 and second cam follower wall means 35 face one another.

The first and second cam track wall 10, 30 means are disposed so as to face one another. The first and second cam follower wall means 15, 35 are disposed so as to oppose one another, e.g. back to back. In such disposition the cam follower means B are provided within the cam track A.

The second cam track wall means 30 provides a second cam track wave or waveform 40. The second cam follower wall means 35 also provides a second cam follower wave or waveform 45.

In use, the second cam track wall means 30 and second cam follower wall means 35 selectively contact, abut, slide relative to, ride upon and/or contact 30 one another. In this way the second cam track wall means 30 and second cam follower wall means 35, in use, interact with one another such that at least a further part of a motion (e.g. rotational motion) of the cam track A defines at least a further part of a motion (e.g. longitudinal motion) of the cam follower B or vice versa.

In this embodiment the first cam track wall means 10 are rotationally or circumferentially continuous. The first cam track wave 20 comprises a periodic waveform. The first cam track wave 20 comprises a sinusoidal waveform.

The second cam track wall means 30 is also rotationally or circumferentially continuous. The second cam track wave 40 comprises a periodic waveform. The second cam track wave 40 comprises a sinusoidal waveform.

In this embodiment the first cam follower wall means 15 are rotationally or circumferentially continuous.

Figure 5B:
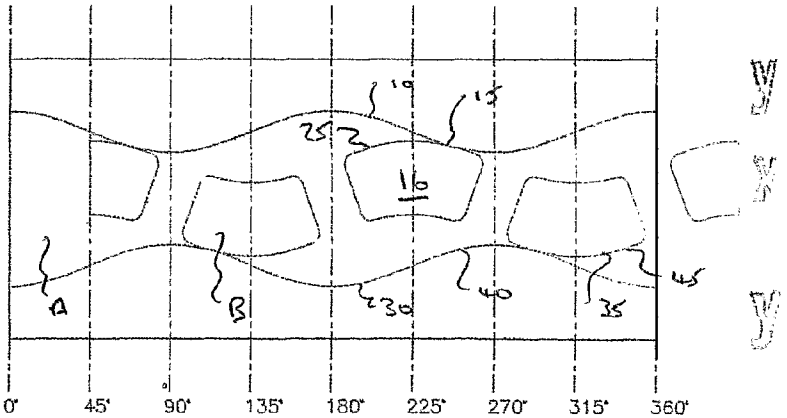
FIGS. 5(*a*) and 5(*b*) a first alternative cam track and cam follower arrangement comprising part of the tool of FIG. 2 in first and second positions, respectively.
Figure 5A:
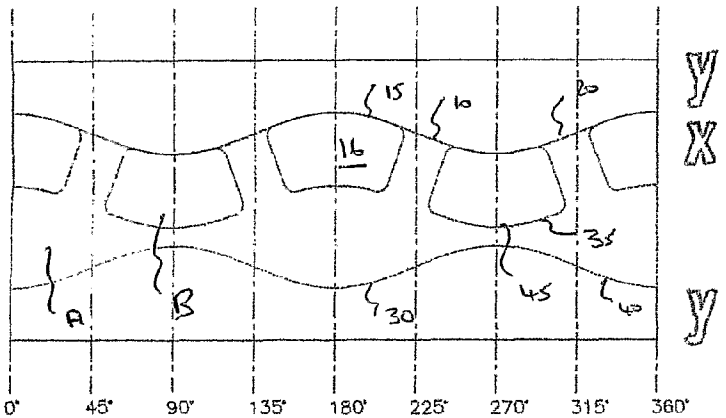

Alternatively, in a modification shown in FIGS. 5(*a*) and (*b*) the first cam follower wall means 15 are provided on a plurality of spaced cam follower members 16.

In either case the first cam follower wall means 15 comprise or define a periodic waveform. The first cam follower wall means 15 comprises or define a sinusoidal waveform.

In this embodiment the second cam follower wall means are rotationally or circumferentially continuous.

Additionally, as shown in FIGS. 5(*a*) and (*b*), the second cam follower wall means 30 are provided on the plurality of spaced cam follower members 16.

In either case the second cam follower wall means 35 comprise or define a periodic waveform. The second cam follower wall means 35 comprise or define a sinusoidal waveform.

The cam follower A comprises first and second, e.g. semi-circular, parts assembled to provide a rotationally or circumferentially continuous cam follower A.

In this preferred embodiment, a longitudinal distance between a peak of the first cam track wave 20 and a peak of the second cam track wave 40 is less than a longitudinal distance between a peak of the first cam follower wave 25 and a peak of the second cam follower wave 45.

In the present preferred embodiment a period or frequency of the first and second cam track waveforms 20, 40 and first and second cam follower waveforms 25, 45 are the same.

Also, in this embodiment the amplitude of the first cam track waveform 20 and first cam follower waveform 25 are the same, and the amplitude of the second cam track waveform 40 and second cam follower waveform 45 are the same. Indeed, in this embodiment all of the waveforms have the same frequency (wavelength) and amplitude. The cam track A thus comprises a cam track waveform and the cam follower comprises a cam follower waveform.

In use, movement of the cam track A causes movement of the cam follower B via interaction of the cam track waveform with the cam follower waveform, or alternatively, vice versa.

Peaks of the first and second cam track waveforms 20, 40 are circumferentially or radially coincident or longitudinally face one another. Troughs of the first and second cam track waveforms 20, 40 are circumferentially radially coincident or longitudinally face one another.

Peaks of the first and second cam follower waveforms 25, 45 are circumferentially or radially coincident or longitudinally oppose one another. Troughs of the first and second cam follower waveform 25, 45 are circumferentially or radially coincident or longitudinally oppose one another.

The cam track A is provided circumferentially on a cam cylinder. In this embodiment there may be provided rotary drive means for rotarily driving the cam track.

In such instance the rotary motion of the cam track A is converted into reciprocal (longitudinal) motion of the cam follower means B.

Alternatively, there can be provided rotary drive means for rotarily driving the cam follower means B. In such instance the rotary motion of the cam follower means B can be converted into reciprocal (longitudinal) motion of the cam track A.

Alternatively, there can be provided reciprocal (longitudinal) drive means for reciprocally driving the cam track A. In such instance the reciprocal motion of the cam track A can be converted into rotary motion of the cam follower means B.

Alternatively, there can be provided reciprocal (longitudinal) drive means for reciprocally driving the cam follower means B. In such instance the longitudinal motion of the cam follower means B can be converted into rotary motion of the cam track A.

The cam track/cam cylinders A are typically made from a metallic material, e.g. phosphor bronze. The cam follower means B are typically made from a metallic material, e.g. phosphor bronze.

A width of at least a portion of the cam track A is greater than a width of at least a portion of the cam follower means B. The cam follower means B and cam track A are therefore a loose fit relative to one another. This is in contradistinction to the prior art, wherein the cam follower means was a close or tight fit within the cam track.

The cam track A and cam follower means B are engaged with one another. The cam follower means B is engaged within, or located in the cam track A. The cam follower means B is adapted to run in the cam track A, e.g. move rotationally by relative to the cam track A, and be thrown between the opposing first and second cam wall means 20, 40 of the cam track A.

A width of at least a portion of the cam follower means B is less than 90%, 80%, 70%, 60%, or 50% of a width of at least a portion of the cam track A. The width of the cam follower means B is in the region of 10% to 90%, or 40% to 80% of the width of the at least a portion of the cam track A.

In use, when not placed against a work surface (unloaded), the cam follower means B can follow a path dictated substantially only by the cam track A.

The cam track A and cam follower means B can be such that, in use, when not placed against a work surface the cam follower means B travels in a path from one portion on one wall of the cam track A to another portion on another wall of the cam track A, preferably without intermediately striking the walls of the track.

Optionally, in use, when placed against a work surface (loaded), the cam follower means B can follow a path dictated by the cam track A and by ricochet of the tool off the work surface and/or the cam follower means B off the first and second wall means 10, 30 of the cam track A.

In the latter case the cam follower means B can therefore have two degrees of motion, a first degree of motion defined by relative rotational motion to the cam track A, and a second degree of motion defined by ricochet between opposing walls of the cam track A. The first degree of motion will have a frequency defined by the cam track A. The second degree of motion will have a higher frequency than the frequency of the first degree of motion. The frequency of the second degree of motion can vary dependent upon the work surface to which the tool is presented.

The first degree of motion causes a substantially longitudinal throw of a tool bit 110 of the tool 5. The second degree of motion causes a substantially longitudinal vibration or chatter of the tool bit 110 of the tool 5.

A width of the cam follower means B is less than a width of the cam track A.

The cam track A comprises a closed (circular) track, and is provided on a cam cylinder 107. The width of the cam track A is constant, or in a modification, varies around the length thereof. The cam follower B comprises a closed (circular) member 106.

The cam track A is recessed, and the cam follower means B received therein. Alternatively the cam follower means B can be recessed, and the cam track A received therein.

The tool 5 is advantageously be a power tool or hand-held tool, e.g. a hand-held power tool.

The tool 5 can be powered by an external electrical supply, which can be of an alternating current (AC) or direct current (DC) nature, e.g. mains electricity (e.g. 110V/240V), or advantageously by a low DC voltage supply (e.g. 12V), e.g. from a motor vehicle or vessel/boat. Alternatively, the tool may be battery powered.

The cam track A or the cam follower means B is rotationally driven by rotational drive means, e.g. an electric motor 145.

In a particularly advantageous embodiment the tool 5 can be adapted for use as a marine growth removal or anti-fouling tool, e.g. barnacle scraper, e.g. for hand-held use possibly submerged under water.

The tool 5 comprises a housing 120, a drive means 145 and a mounting arrangement for tool bit 110, wherein there is provided within the housing 120 an output arrangement adapted to drive an output shaft in a reciprocal axial movement to drive the tool bit 110, and the drive means 145 is substantially sealed (e.g. against fluid ingress) from external of the tool 5. This arrangement allows the tool 5 to be used underwater or in wet/moist environments.

In alternative advantageous embodiments the tool 5 comprises a handyman's or tradesman's tool.

The tool 5 is typically adapted for use as a scraper, paint stripper, wallpaper stripper, chisel, cold chisel, power spade, hammer or the like.

In a further alternative embodiment the tool 5 can comprise or be adapted for use as a downhole tool (see FIGS. 9(*a*) to 13(*b*)).

The tool 5 may comprise one or more of:

the housing 120;

a drive means 145 comprising rotary drive means, e.g. electric motor;

a cylinder cam 107 having the cam track A extending around a circumferential surface thereof;

a mounting arrangement for (releasably holding) a tool bit 110, one of the cam track A and cam follower means B being driven by the drive means 145;

the mounting arrangement being associated with one of the cam track A and the cam follower means B, such that actuation of the drive means 145 drives reciprocal movement of the mounting arrangement;

at least part of the cam track A being in the form of a wave having an amplitude and a wavelength, the wave having a forward throw section, and a rearward throw section, which, in use, drive the mounting arrangement respectively forward and rearward.

There can be provided a plurality of interchangeable tool bits 110, e.g. for use with differing work surfaces.

The tool 5 therefore comprises a cam track A and a cam follower means B, wherein the cam track A comprises a cam track waveform and the cam follower B comprises a cam follower waveform. In use, movement of the cam track A causes movement of the cam follower B via interaction of the cam track waveform with the cam follower waveform or alternatively vice versa.

There are provided drive means 145 for rotary driving the cam track A. In such instance the rotary motion of the cam track A is, in use, converted into reciprocal (longitudinal) motion of the cam follower means B.

Alternatively, there can be provided drive means for rotarily driving the cam follower means B. In such instance the rotary motion of the cam follower means B is converted into reciprocal (longitudinal) motion of the cam track A.

Alternatively, there can be provided reciprocal (longitudinal) drive means for reciprocally driving the cam track A. In such instance the reciprocal motion of the cam track A can be converted into rotary motion of the cam follower means B.

Alternatively, there may be provided reciprocal (longitudinal) drive means for reciprocally driving the cam follower means B. In such instance the longitudinal motion of the cam follower means B can be converted into rotary motion of the cam track A.

The cam track A and/or cam cylinder F are, in this embodiment, made from a metallic material, e.g. phosphor bronze. The cam follower means B can also be made from a metallic material, e.g. phosphor bronze.

The tool 5 comprises a plastics housing 120 and tool bit 110 in the form of a scraper blade 125. The blade 125 is mounted on a reciprocating shaft 130, which is powered by an internal motor (described below). One end of a power cable 135 enters the casing 120, while another end leads to a power supply (not shown), for example, a battery located on a boat. The casing 120 also includes an activating button or trigger mechanism 140, which can optionally provide a "dead-man's handle" safety feature, and a hand guard 145, located so as to protect a user's fingers when holding the tool 5. Internal components of the tool 5 are shown in the exploded view of FIG. 3.

The power cable 135 leads to drive means 145 comprising a low power rotary motor, which drives a rotatable output shaft 150. The motor is "low power" in the sense that a typical motor as used in the present invention, runs at 12-24V typically on 2-4 A, as opposed to conventional motors for existing reciprocating power tools, which run at no less than a few hundred watts. This allows the tool 5 to be particularly portable.

Mounted on the rotary output shaft 150 is a cylinder cam 155 with circumferentially arranged cam track A.

Received in the cam track A are cam follower means B which are connected via a frame 160 to an output shaft 165. Mounted on the output shaft 65 are a number of parts 170 and a cover 175, which serve to secure the scraper blade 25 to the shaft 165. The tool 5 also comprises a blade holder 176. In certain embodiments of the present invention, a plurality of interchangeable blades 170 can be provided, in order to adapt the tool 5 for use in different applications and/or use on differing work surfaces.

In use, electric rotary motor 145 drives rotary output shaft 150, which in turn rotates cam 155, which bears cam track A. Cam follower means B is driven in an axially reciprocating motion by the rotational motion of the cam 155, the cam follower means B in turn being mounted in frame 160, which is itself connected to tool blade 115 via output shaft 165.

The rotary motor 145 is typically capable of driving an axially reciprocating blade 115 at up to 14,000 cycles per minute with relatively little waste heat generated, compared to conventional reciprocal motors.

Thus, the present invention provides a tool 5, which can be sealed from moisture or other hazardous environments, and therefore is suitable for use as a marine growth remover, among other applications, the drive means beneficially requiring no cooling means, e.g. slots or vents in the housing. Sealing means can be provided as described in WO 01/60594.

Figure 6A:
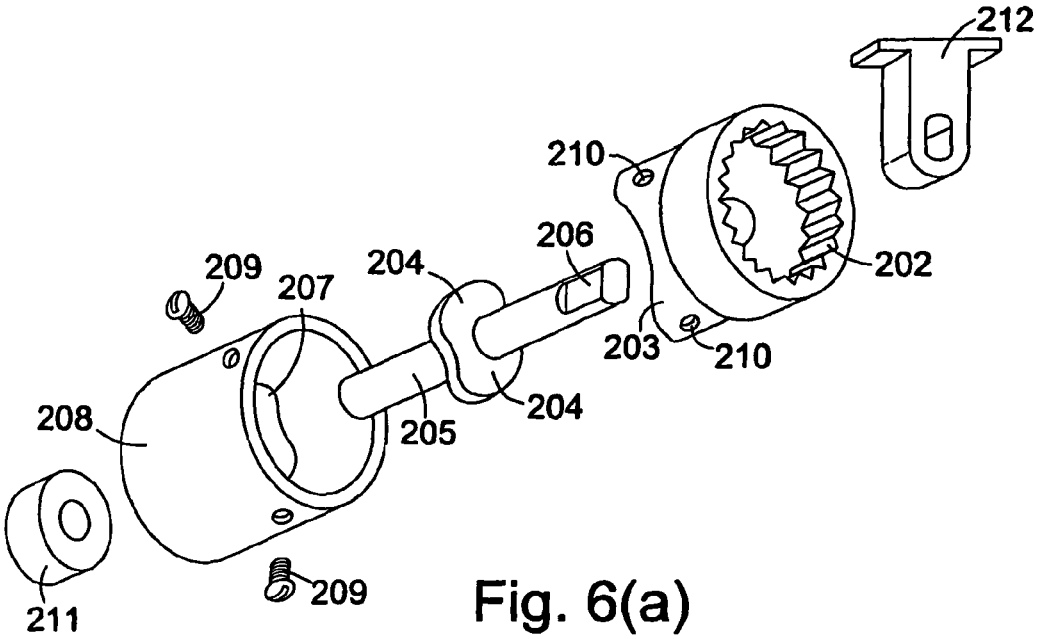
FIGS. 6(*a*) and (*b*) an exploded perspective view from one side and to one end and an assembled side view, respectively, of a second alternative cam track and cam follower arrangement according to the present invention.
Figure 6B:
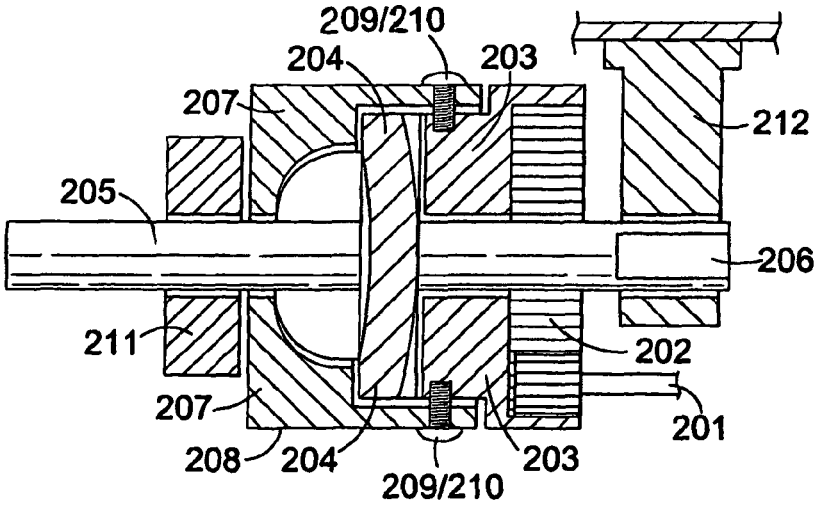

Referring now to FIGS. 6(*a*) and (*b*) there is shown a second alternative cam track A and cam follower B arrangement according to the present invention. The second cam track A and cam follower B arrangement is similar to the arrangement of FIGS. 2 to 4(*b*), like parts being designated by like numerals and letters.

Cam drum 208 is split into two parts 203 and 207, each having a Y shaped wave form so aligned as to allow the passage between them of the X shaped wave form constituting part 104 which is securely attached to, or forms, an integral part of shaft 205. The two parts of the cam drum are secured together in position by fixings 109 and 110. The cam drum 108 is arranged to rotate only and is restrained from lateral movement. The shaft 105 and connected wave form 104 are prevented from rotation by flats 206 cut into the shaft 205, which engage with the matching receptor cut into the fixed bearing 212. The shaft 205 is led through forward fixed bearing 211, and so as the drum 108 rotates the shaft 205 must reciprocate. The cam drum 208 is shown with an integrally cut gear 202, which engages with a drive shaft and matching gear 201.

Figure 7A:
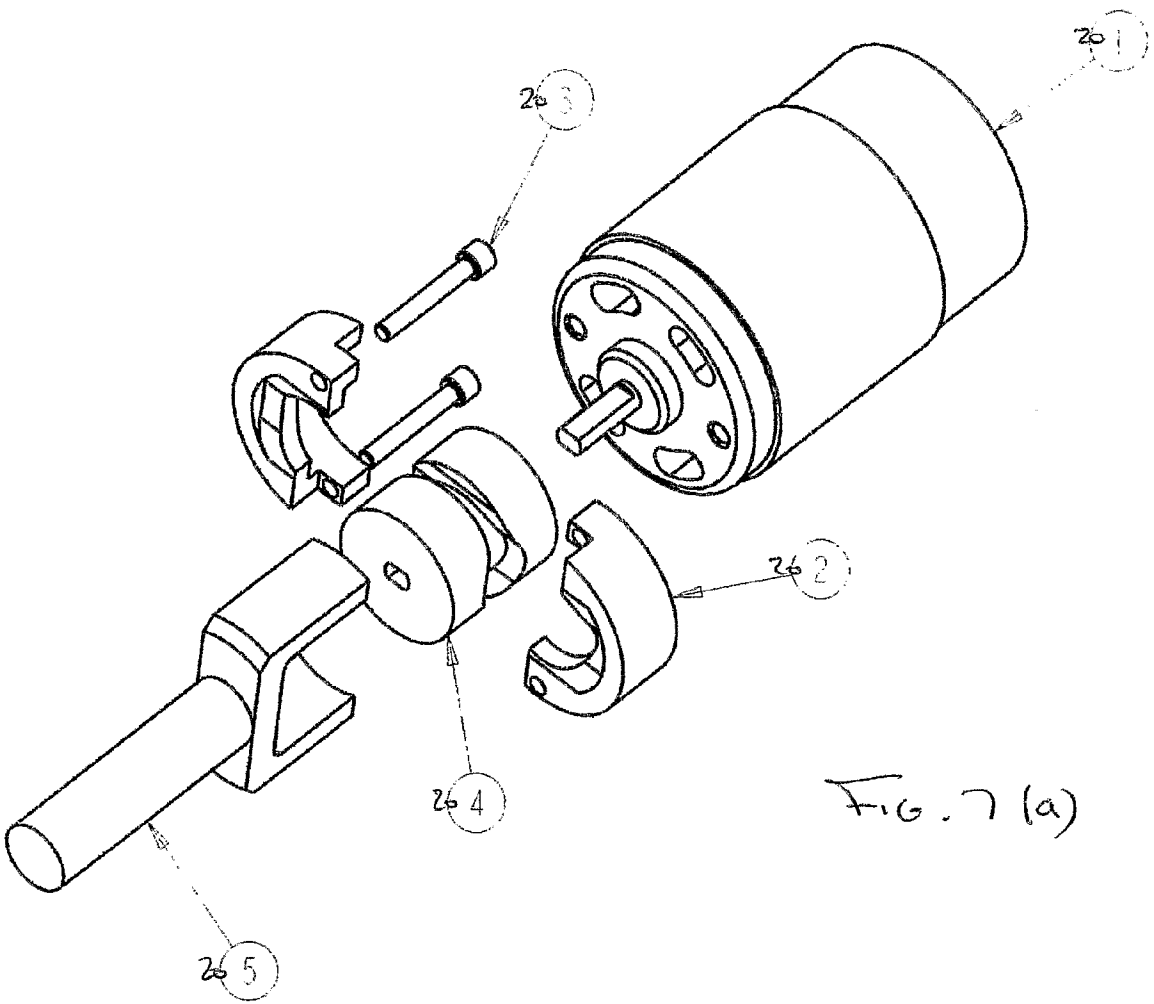
FIGS. 7(*a*) and (*b*) an exploded perspective view from one side and to one end and an assembled side view, respectively, of a third alternative cam track and cam follower arrangement according to the present invention.
Figure 7B:
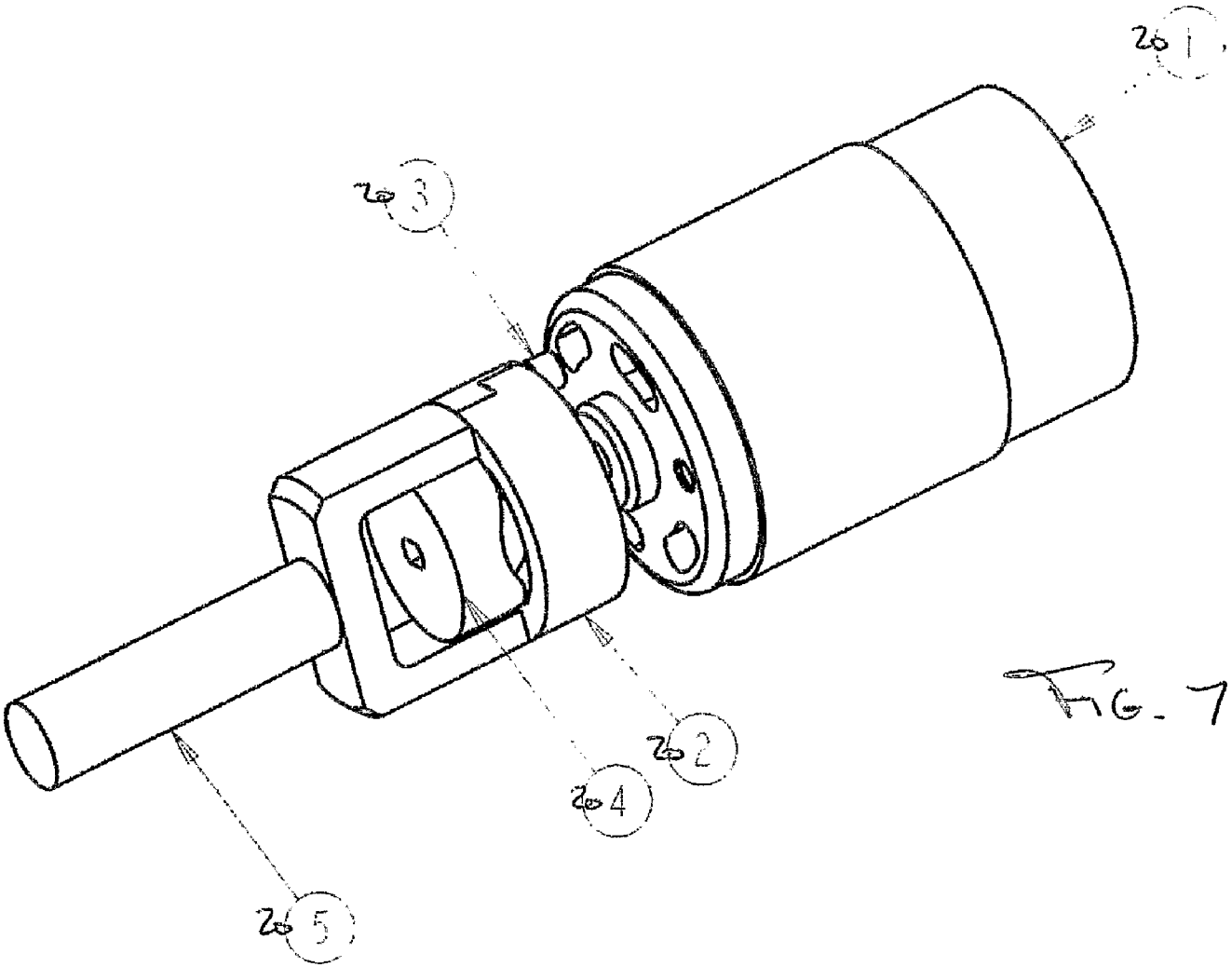

Referring now to FIGS. 7(*a*) and (*b*) there is shown a third alternative cam track A and cam follower B arrangement according to the present invention. The third cam track A and cam follower B arrangement is similar to the arrangement of FIGS. 2 to 4(*b*), like parts being designated by like numerals and letters.

The component parts of the mechanism are:

(1) A motor or rotary drive system; this may use compressed air, hydraulic or electrical power. An electric motor 201 is shown.

(2) A circular collar 202 split into parts to engage the drive cam 204. The inner face of this collar is provided with one of the waveforms (see FIGS. 4(*a*) and (*b*) and wave X).

(3) The assembled collar 202 is secured to yoke and shaft 205 by machine screws or other such fixings 203.

(4) The collar 202 is secured round the drive cam 204, which bears the complimentary wave form (see FIGS. 4(*a*) and (*b*) and wave Y), such that the waveforms engage one with the other. The drive cam is firmly secured to the motor drive shaft.

(5) Yoke and shaft assembly 205 is secured to the circular collar 202 by fixings 203. The yoke is restrained from rotating under the influence of the drive cam in motion by flats, or other means of restraint incorporated into the mechanism mounting.

Thus, it is that when the motor or rotary drive means 201 rotates the cam 204, the interacting waveforms (X, Y) incorporated into the collar 202 and cam 204 cause the collar 202 and connected yoke and shaft assembly to move back and forth.

Figure 8A:
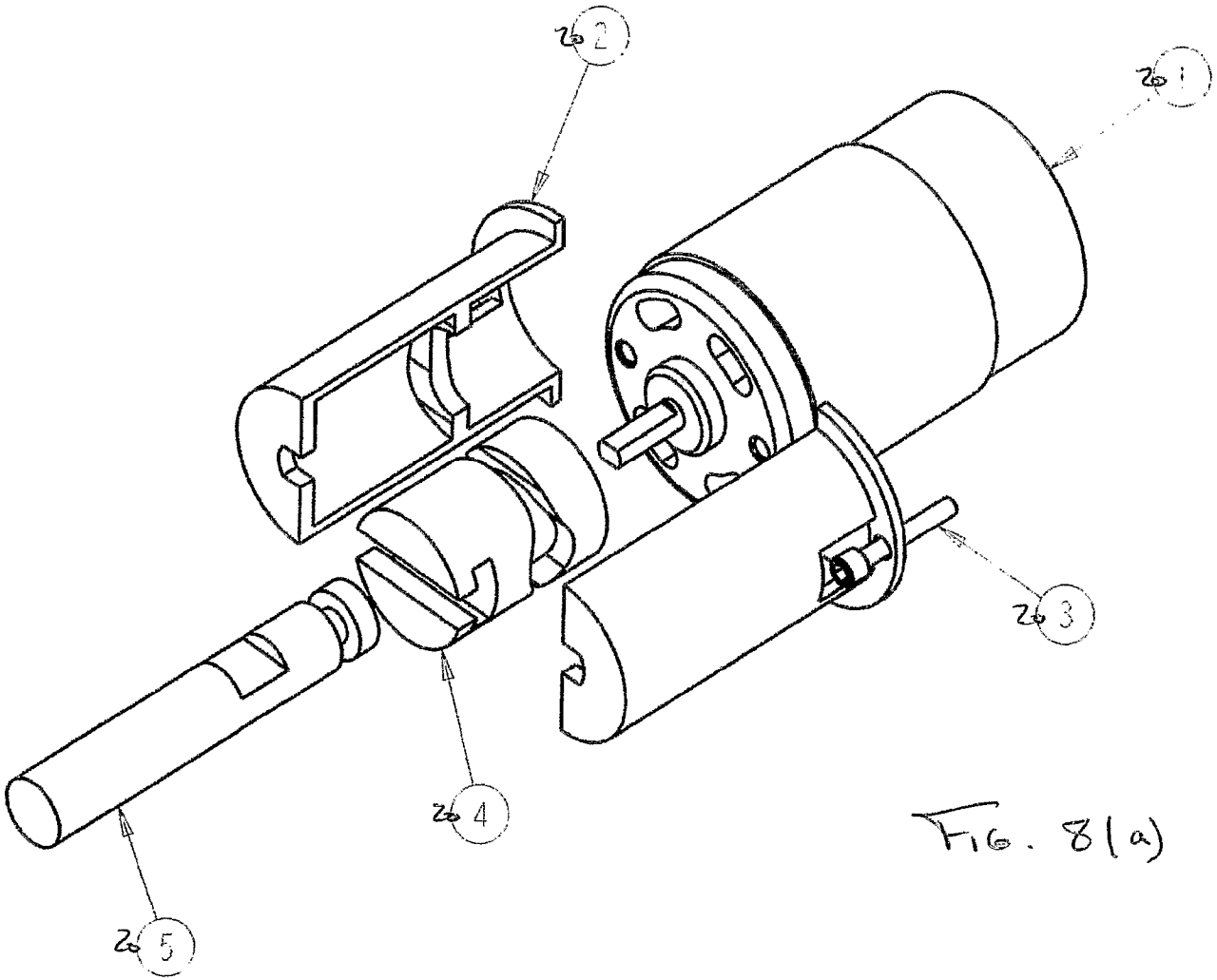
FIGS. 8(*a*) and (*b*) an exploded perspective view from one side and to one end, and an assembled side view, respectively, of a fourth alternative cam track and cam follower arrangement according to the present invention.
Figure 8B:
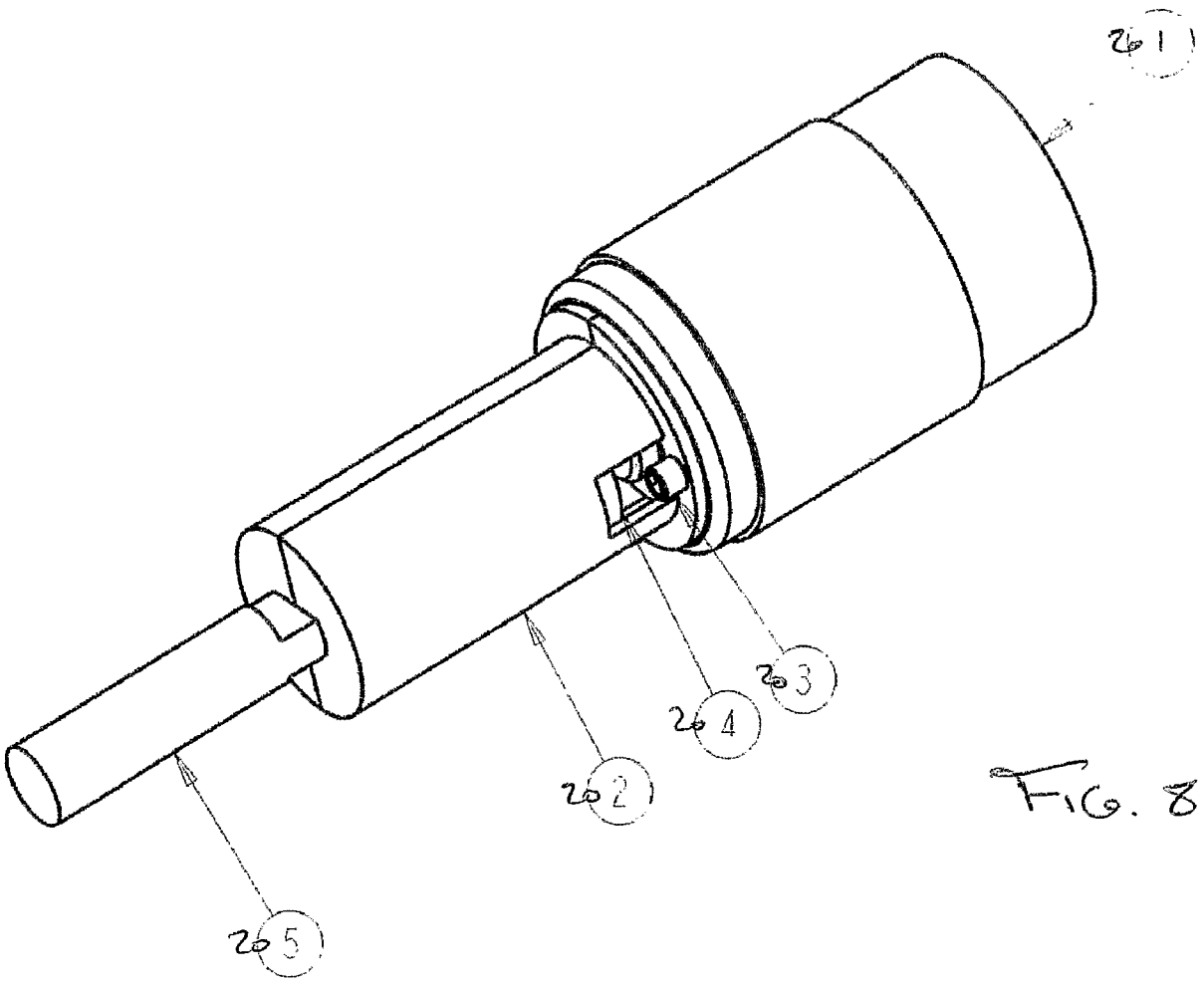
Figure 9A:
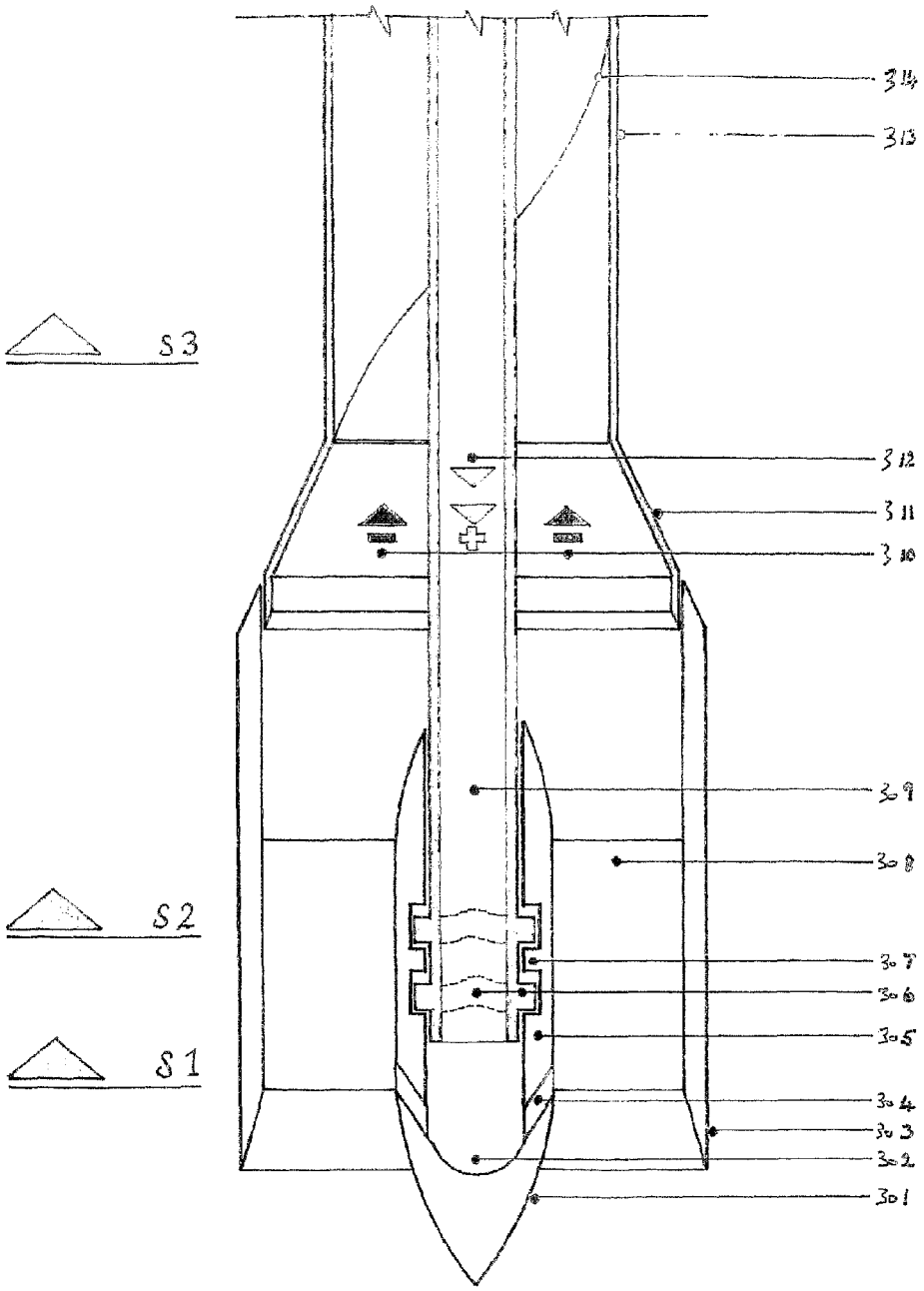
FIG. 9(*a*) a sectional side view of a downhole tool according to a second embodiment of the present invention.
Figure 9F:
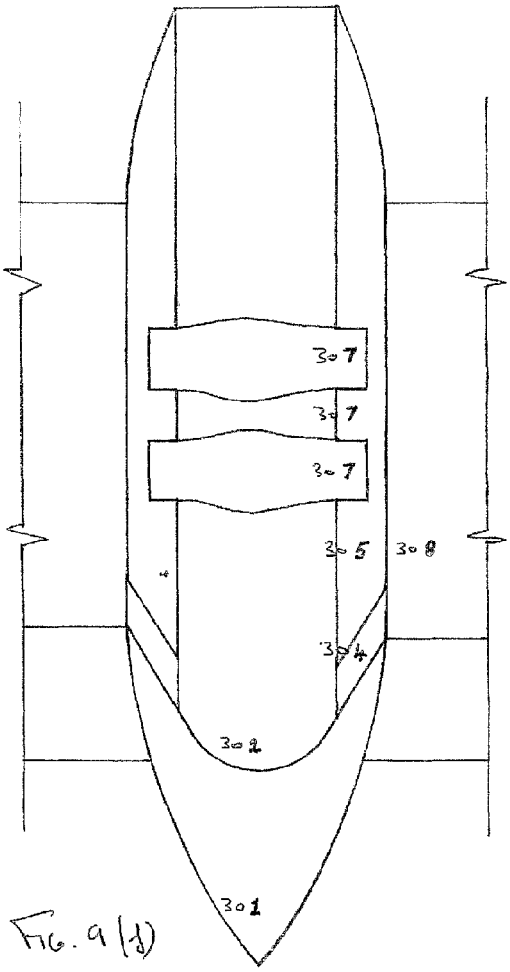
Figure 9H:
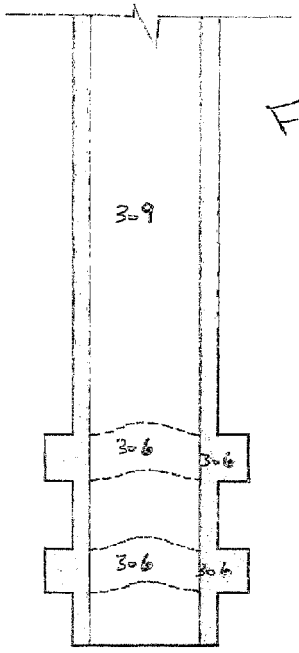
Figure 9G:
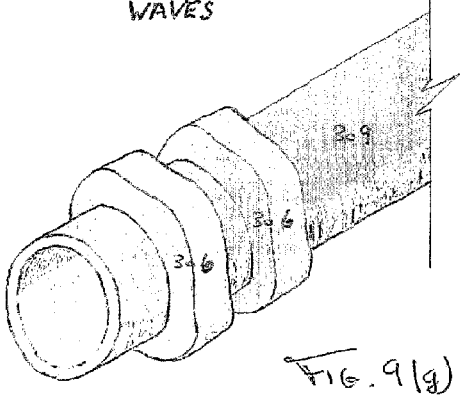

Referring now to FIGS. 8(*a*) and (*b*) there is shown a fourth alternative cam track A and cam follower B arrangement according to the present invention. The fourth cam track A and cam follower B arrangement is similar to the arrangement of FIGS. 2 to 4(*b*), like parts being designated by like numerals and letters.

The component parts of the mechanism are:

(1) A motor or rotary drive system; this may use compressed air, hydraulic or electrical power. An electric motor 201 is shown.

(2) A circular casing 202 split into parts to engage the drive cam 204 and output shaft 205. This casing is securely fixed to the front of the drive means or any suitable part of the mechanism mounting to restrain it from rotating under the influence of the drive cam 204. The casing is provided with one of the waveforms (see FIGS. 4(*a*) and (*b*) and wave X).

(3) The assembled casing is here shown secured to the front of the motor by machine screws 203.

(4) The casing is secured round the drive cam 204, which bears the complimentary wave form (see FIGS. 4(*a*) and (*b*) and wave Y, such that the waveforms engage one with the other. The drive cam is not fixed, but free to move fore and aft on flats cut into the motor drive shaft. The cam must rotate with the motor shaft due to the shape of the recess cut into the cam to accept the motor drive shaft.

(5) The output shaft 105 is equipped with a stud end which engages with an appropriately shaped recess cut into the forward face of the drive cam 204. This engagement ensures that the output shaft 205 must move laterally fore and aft in unison with the drive cam 204, but does not rotate with it. The output shaft 205 is restrained from rotating with the cam 204 by flats cut into the shaft which engage with matching flats cut into the forward face of the casing 202.

Thus, it is that when the motor or rotary drive means 201 rotates the cam 204, the interacting waveforms (X, Y) incorporated into the casing 202 and cam 204 cause the cam 204 to rotate and move laterally on the motor drive shaft. This in turn moves the output shaft 205 laterally in unison with the cam 204, but rotary motion which would otherwise be imparted to the output shaft 205 by the cam 204 is denied by the engagement of the shaft flats with the matching casing forward face flats.

Referring now to FIGS. 9(*a*) to (*g*) there is shown a tool comprising a downhole tool according to a second embodiment of the present invention.

FIG. 9(*a*) shows that the tool comprises a mechanism comprising a metal pod 305 with a point nose 301 encasing the end of a hollow rotary drive tube 309, which has a wave form or series of waveforms 306 of type X (see FIGS. 2(*a*) and (*b*)) standing proud round the end of the drive tube 309. The waveform or waveforms 306 engage with complimentary waveforms 307 of type Y (see FIGS. 2(*a*) and (*b*)) recessed into the pod walls 305.

The pod 305 is hollow with a domed end 302, which has a series of exit holes 304 arranged around the perimeter. Affixed radially to the outer face of the pod 305 are a series of metal wings 308, which in turn support a circular casing 303. Both casing 203 and wings 308 have sharp fore edges.

Above the casing 303 mounted around the drive tube 309 is a metal outer tube 313 having a bell housing 311 engaging with an open rear end of the casing 303. Contained within the tube 313 and fixed to the outer walls of the drive tube 309 is an Archimedes screw 314.

A method of operation of the tool is as follows. The hollow drive tube 309 is rotated at speed and pressed down so as to bring the pod 305 together with wing 308 and casing 303 assembly into contact with the surface to be drilled. Before contact with the surface, the pod 305, wing and casing assembly will naturally rotate under the influence of the drive tube. In contacting the surface however, the pod 305, wing and casing will cease to rotate due to the friction created by surface contact and start to vibrate due to the interaction of the waveforms X and Y moving over each other. The speed of rotation of the drive tube 309 will then be increased, thus increasing the rate of vibration of the pod 305, wing and casing assembly to the point where the granular constituents of the surface to be drilled vibrate in sympathy, lose cohesion and become free.

Gas or a liquid medium under positive pressure 318 is pumped down the hollow core of the drive tube 309 exiting the pod 305 through the perimeter holes 304. This medium mixes with the loosened, free, material from the drilled surface and is carried back away from the drilling face up the outer tube 313 by the combination of positive pressure of the medium, negative pressure 310 maintained within the outer tube 313 and the influence of the Archimedes screw 314.

Referring now to FIGS. 9(*c*) to (*e*) this drawing shows a number of lateral sections through the mechanism shown in FIG. 9(*a*).

Cross-section S1 shows the casing 313, wings 308, pod 305, exit holes 304, and areas of negative pressure 310. Also shown is the hollow drive tube 309 through which the medium passes with corresponding positive pressure 312.

Cross-section S2 shows the casing 303, wing 308, pod 305, drive tube 309, and pressure areas 310 and 312 as before, but also includes the engaged X and Y waveforms 306 and 307.

Cross-section S3 shows the hollow drive tube 309 with positive internal pressure area 312 surrounded with the Archimedes screw 314 within the outer tube 313.

Isometric FIG. 9(*b*) shows the arrangement of the component parts pictorially.

Referring now to FIGS. 9(*f*) to (*h*) these Figures show in greater clarity the components of the mechanism numbered as before.

Figure 10:
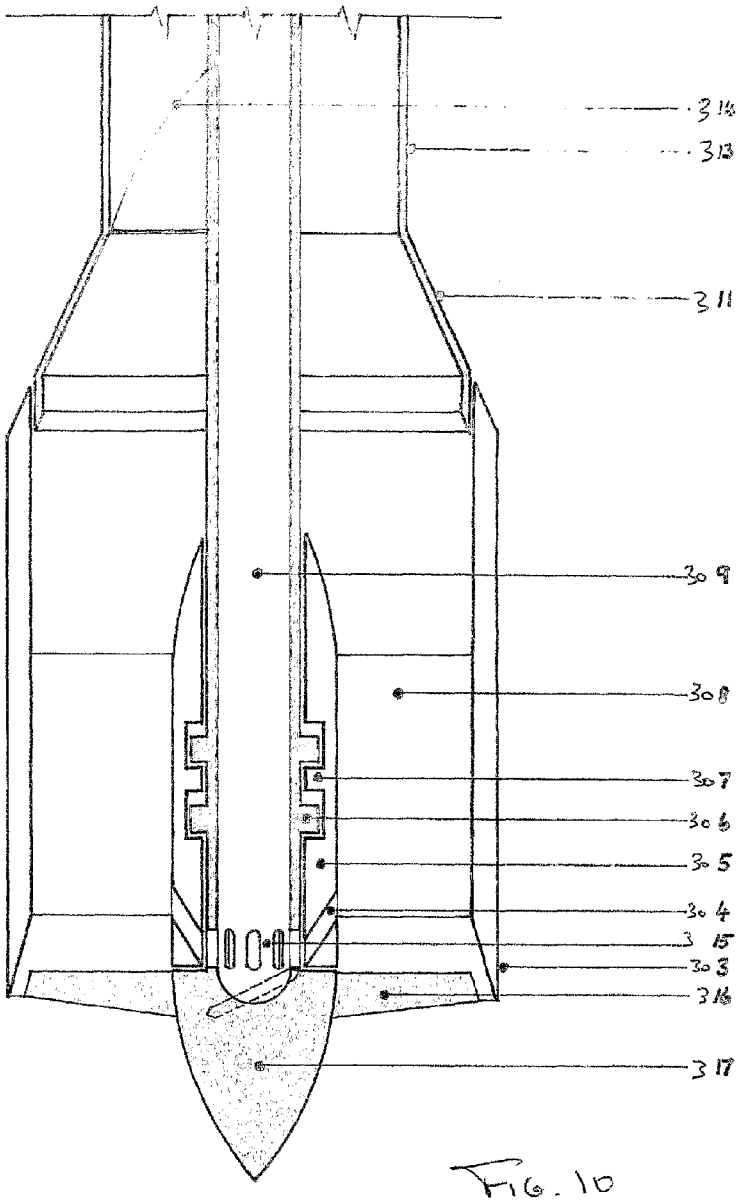
FIG. 10 a sectional side view of a first modification to the downhole tool of FIG. 9(*a*)

Referring now to FIG. 10, this shows the mechanism as illustrated and described above, but with the added measure of extending the hollow drive tube 309 to form a conical spinner 317 which rotates with the drive tube 309. Exit holes 315 for the pressurised medium are arranged to coincide with the exit holes 304 in the pod 305. A series of blades 316 whose angle of pitch may be remote controlled and powered through exploiting the positive pressure inherent in the gas or fluid medium.

The method of operation of the mechanism is as follows. The operation of the mechanism is similar to that described above with the additional facility of having a powered cutter enabling the drill to address harder surfaces than those susceptible to vibration only. Changing the pitch of the cutter blades will facilitate progress through strata of varying resistance.

Figure 11:
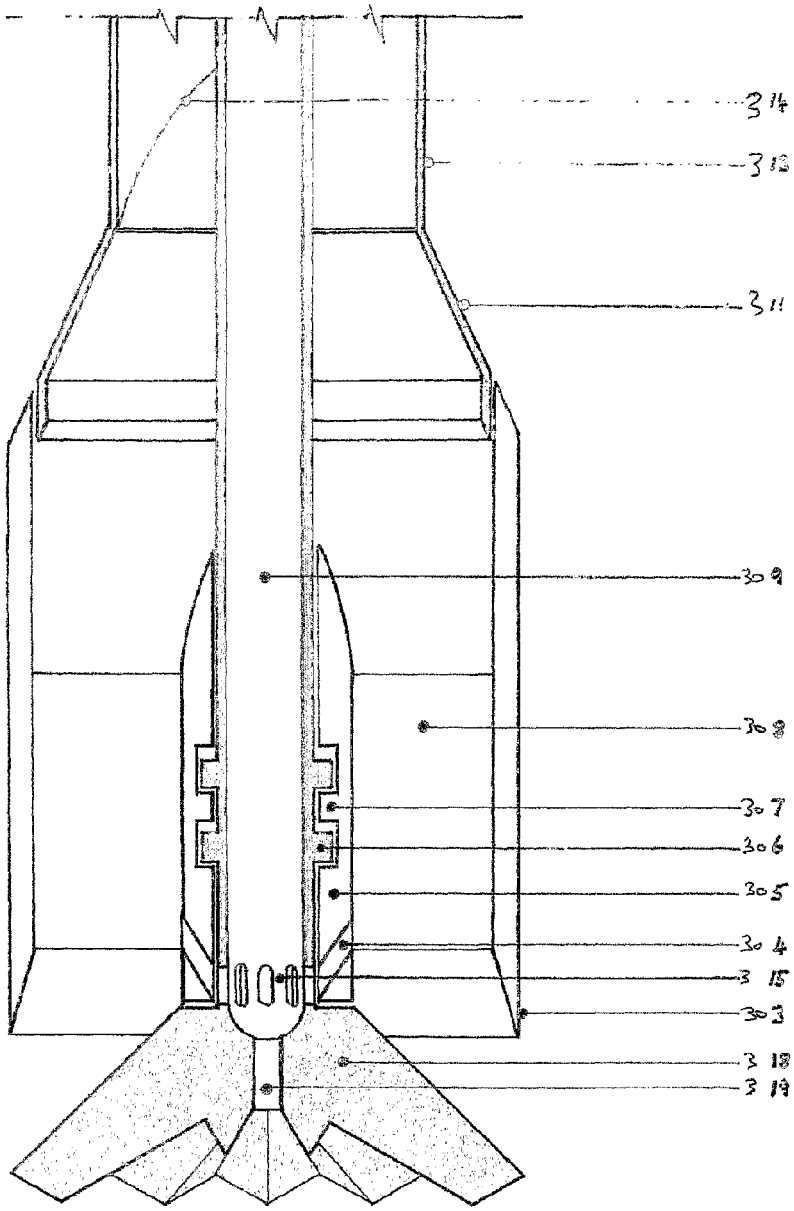
FIG. 11 a sectional side view of a second modification to the dowhhole tool of FIG. 9(*a*)

Referring now to FIG. 11, in this case all is as hereinbefore, with the exception of the substitution of a more conventional drill head 318 for the spinner 317 and blades 316. The pressurised medium is allowed to escape through aperture 319 ahead of the drill bit 301 as well as exit through holes 304.

Figure 12A:
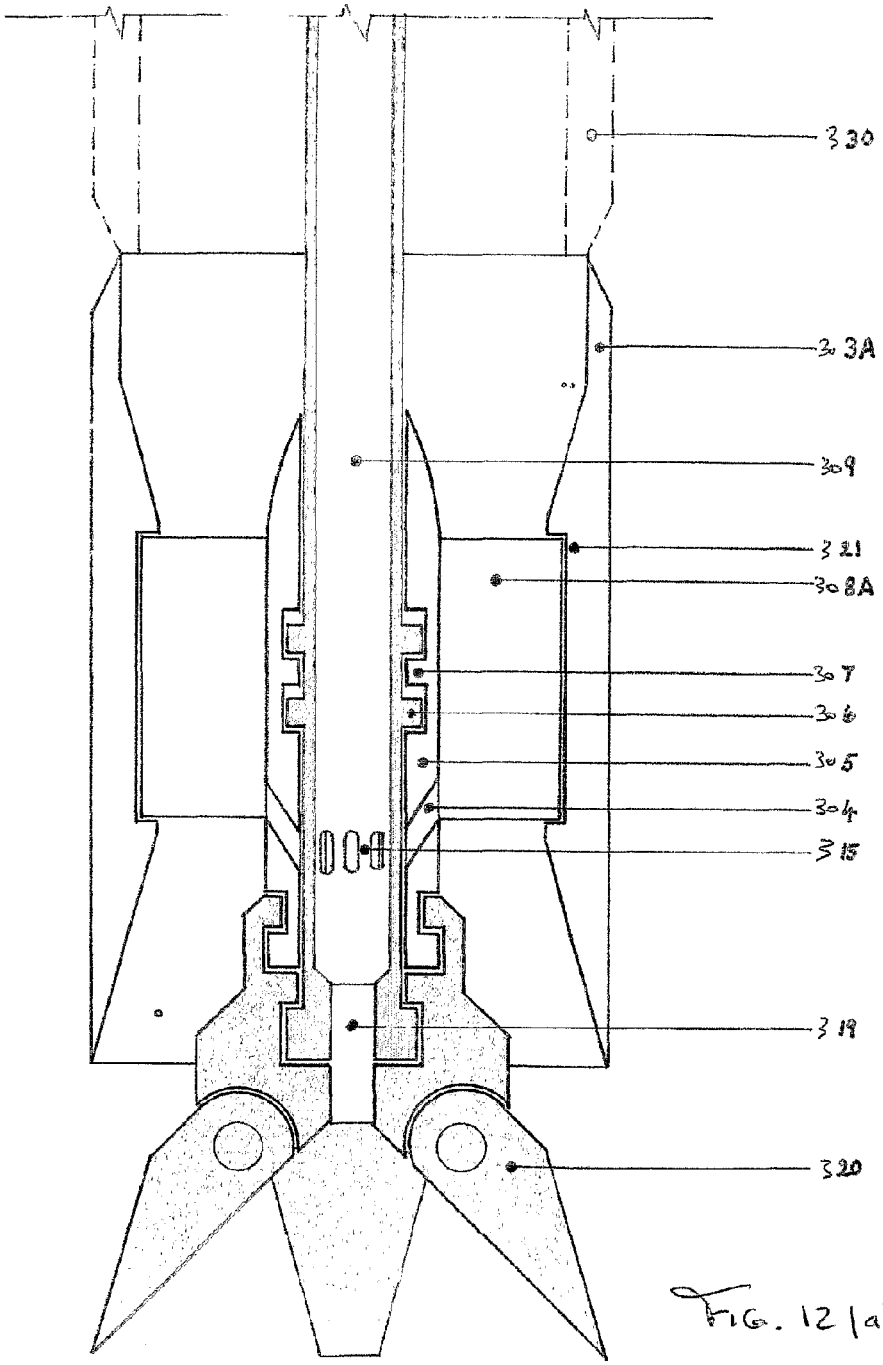
FIG. 12(*a*) a sectional side view of a third modification to the downhole tool of FIG. 9(*a*) in a first disposition.
Figure 12B:
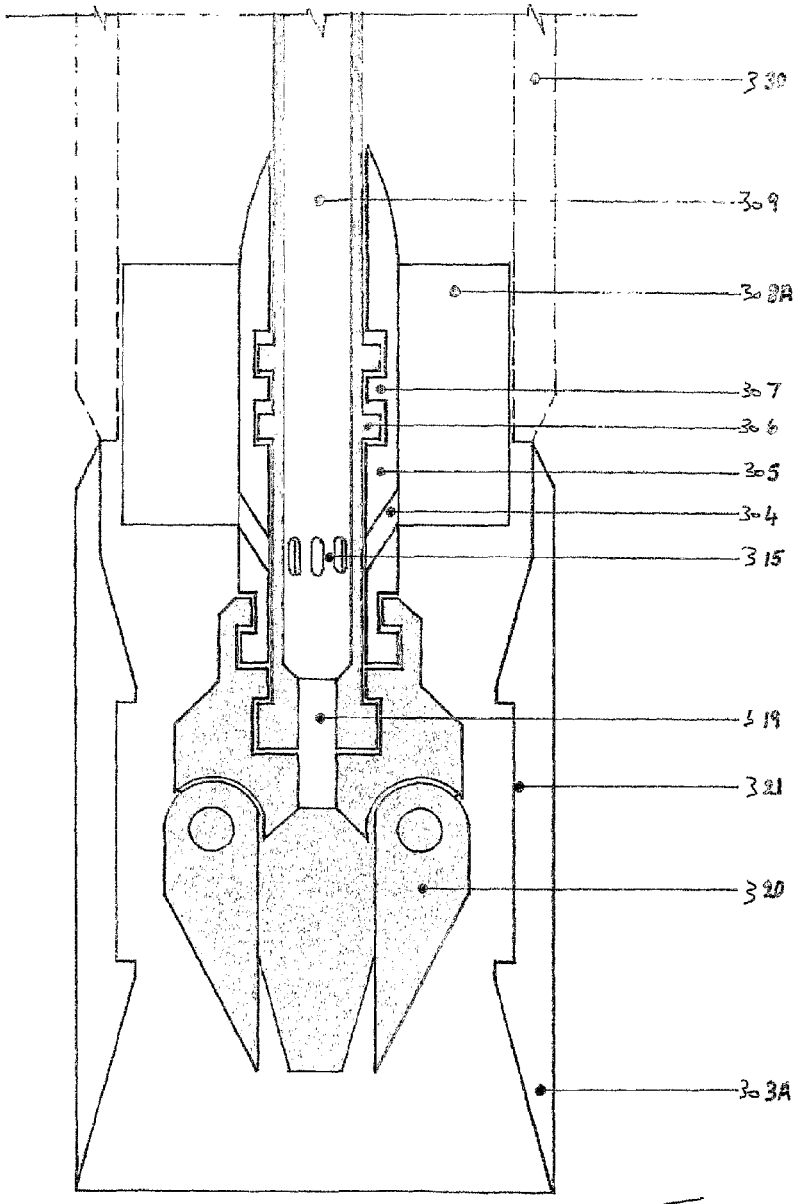

Referring now to FIG. 12(*a*), this shows the basic mechanism with the following changes; the radial wings 20208A are fixed to the pod 309 as before but left free and unattached to the inner face of the casing 303A. Instead, the free ends of the wings 308A are arranged to slot into vibration locks 321 (see FIGS. 12(*c*) to (*e*)) on the inner face of the casing 303A. The wings 308A are held into the blind ends of the vibration locks 321 by the direction of rotation of the drive tube 309 acting on the wing/casing assembly. The drill 320 rotates with the drive tube 309 as before but the drill head 320 in this instance is arranged to have retractable cutting faces. The first section of well casing 330 is indicated.

The method of operation of the mechanism is as follows. With the help of the twin benefits of vibration and rotary cutting, the drill head, pod and casing assembly works forward into the strata aided by the continuous excavation of debris up the shaft so cut under the influence of the pressurised gas or liquid medium. Sections of outer casing follow the drill assembly into the shaft.

Referring next to FIG. 12(*b*), this shows the mechanism as described hereinabove with the drill cutting faces retracted, the drill, pod and wing assembly 320, 305, 308A disengaged from the casing 303A and being withdrawn from the shaft. This is achieved by reversing the direction of rotation of the drive tube 309 so freeing the ends of the radial wings 308A from the vibration locks 321 in the casing 303A.

Referring next to FIGS. 12(*c*) and (*d*), these show two lateral sections through the casing 303A with the wings 308A shown engaged and disengaged with the vibration locks 321. An isometric sketch of a vibration lock is also shown—see FIG. 12(*e*).

Figure 13A:
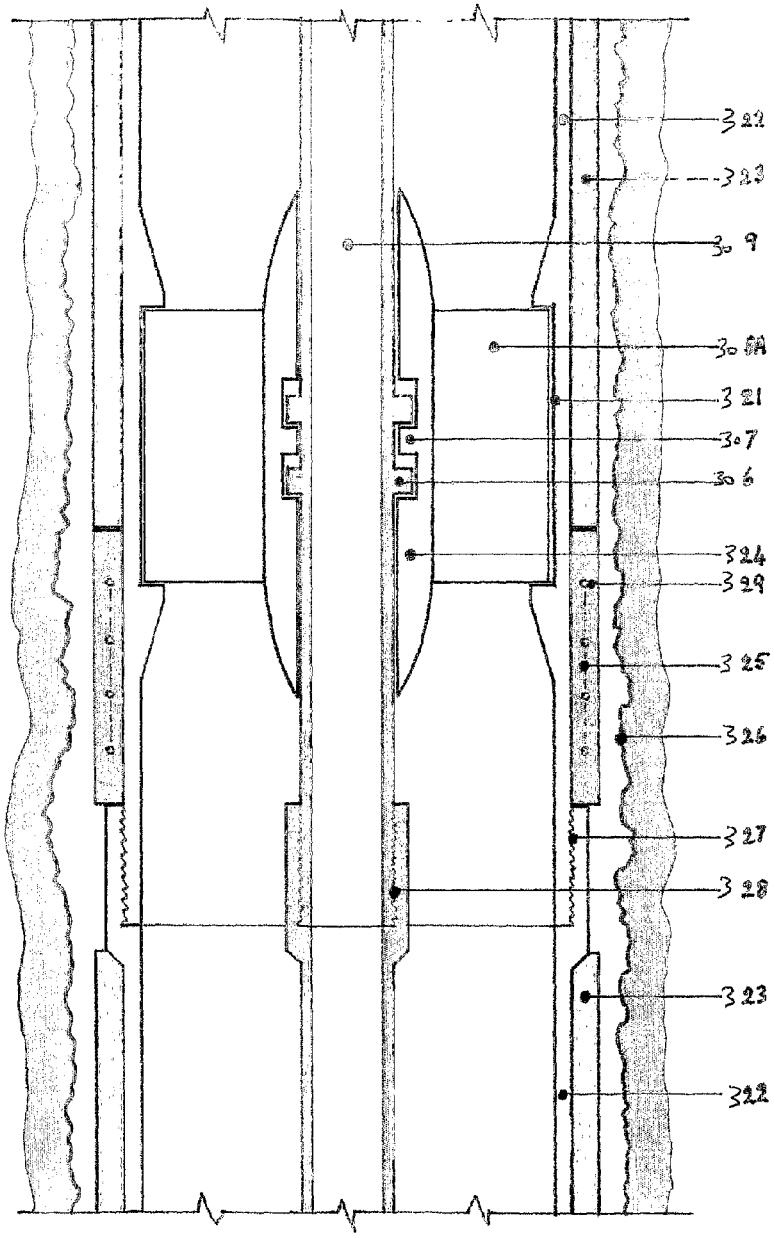
FIG. 13(*a*) a cross-sectional side view of a fourth modification to the downhole tool of FIG. 9(*a*) in a first disposition.
Figure 13B:
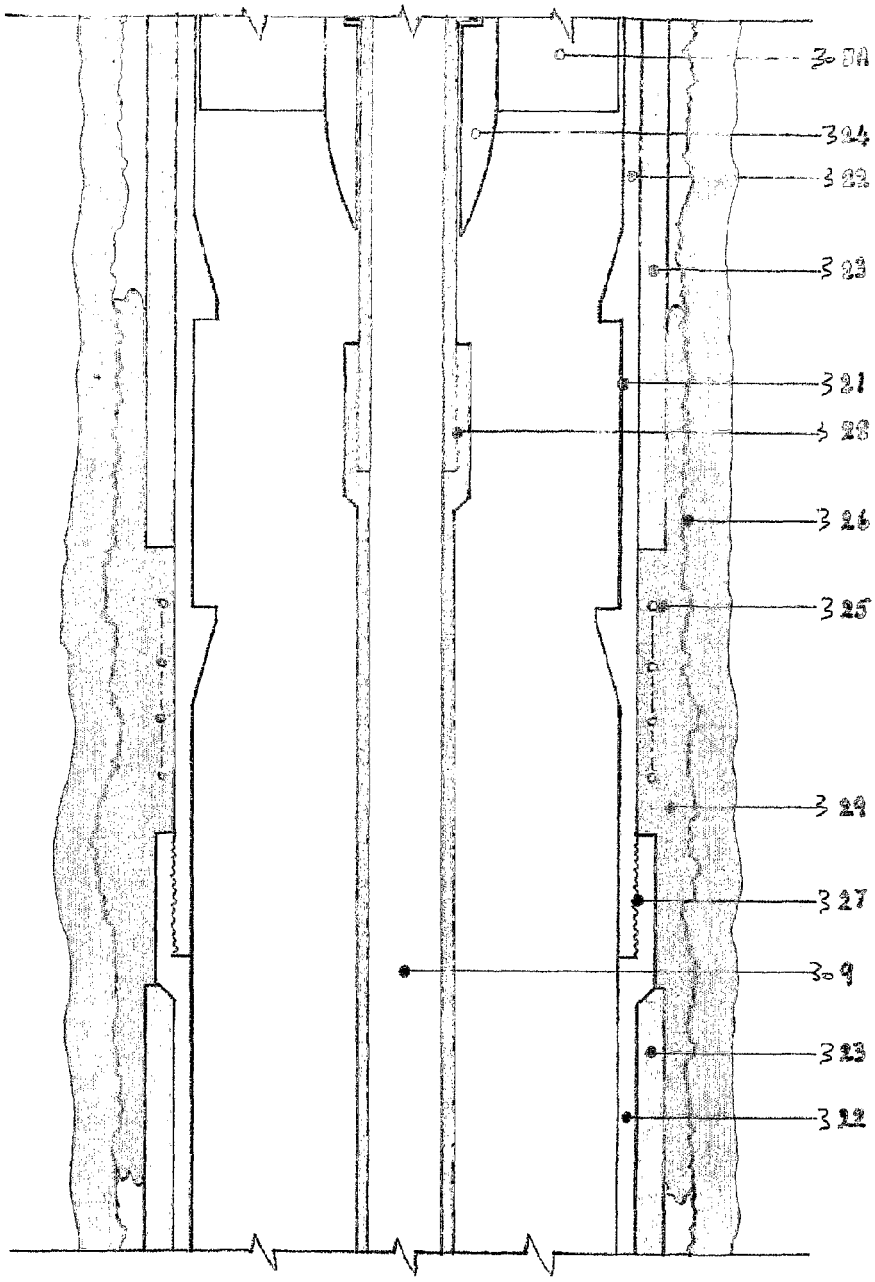

Referring now to FIG. 13(*a*), there is shown a vertical section through the drilled shaft which has resulted from the action of the mechanisms described above. In this case the shaft casing tubes 322 are shown screw jointed 327 in sections, as is the hollow drive tube 309 at 328. At intervals down the length of the drive tube 309 dependent on the strata conditions, pod units similar to that incorporated behind the drill head are fed into the drive tube lengths. As before these tube lengths and pod units are provided with interacting waveforms 306 and 307 (X and Y forms—see FIGS. 2(*a*) and (*b*)), which will cause the pods to vibrate. The pods are equipped with wings 308A engaging with vibration locks 321 on the inner face of the shaft casing tubes arranged to coincide with the pods as required by drilling conditions. The outer surfaces of the shaft casing tubes are pre-coated with a thin layer of hard and durable cement 323 up to the screw joint zone of each tube length. Incorporated at each tube screw joint zone is a collar made of hard intumescent material which contains within it an electrical heating coil 329 connected and controlled from a surface station. The irregular side of the drilled shaft is indicated by 326.

Referring next to FIG. 13(*b*), this is similar to FIG. 13(*a*) with the exception that the drive tube 309 direction has been momentarily reversed to disconnect the pod wings 308A from the shaft casing tube vibration locks 321 and the drive tube assemblies withdrawn. The intumescent collars 225 have been fired to lock the casing tubes 322 in place.

The method of operation of the mechanism is as follows. As the drill head mechanism cuts down into the ground strata, shaft casing tubes 327 pre-coated with hard cement jackets 323 and equipped with intumescent collars 325 are fed down behind the drilling head 320, pod 305, wing 308A and casing 303A assembly. The action of the vibrating pod 324 assemblies along the length of the shaft casing tube 322 line will assist in reducing any tendency for jamming of the casing tubes during insertion.

An alternative method of operation may be to restrain the vibrating action of the intermediate pod 324 assemblies from taking place until shaft casing tube insertion does jamb. The instant this occurs the intermediate pod assemblies kick into action when a level of resistance is exceeded, thus immediately freeing the momentarily jammed shaft casing tubes.

When the required depth has been reached the drill head 320 and drive tube reverse direction to disconnect the pod wings 308A from the vibration locks 321. The drive tube and drill head are withdrawn.

The intumescent collars 325 are then triggered to violently expand by the heating of the imbedded electrical heating coils 329. This action locks the shaft casing tubes into the shaft itself negating the need for time and effort consuming operations to cement the shaft lining tube into the drilled shaft.

In a further alternative embodiment the tool may comprise at least first cam follower means and at least one further cam follower means.

In such case the tool may comprise a first respective tool bit or head, e.g. connected to the at least first cam follower means, e.g. by means of a respective connection means such as a shaft.

In such case the tool may comprise at least one further respective tool bit or head, e.g. connected to the/one of the at least one further cam follower means, e.g. by means of respective cam follower means such as a shaft.

In one version of the alternative embodiment the at least first cam follower means and at least one of the at least one further cam follower means may be associated with (e.g. in use, run around) the/one of the at least one of the cam tracks.

In another version of the alternative embodiment the at least first cam follower means may be associated with one of the at least one cam tracks and at least one of the at least one further cam follower means is associated with another of the at least one cam tracks.

In the one version and the another version the at least one cam follower means and the at least one further cam follower means may be substantially the same, though, e.g. provided rotationally separate from one another. In this way the at least one cam follower means and further at least one cam follower means may, in use, impart substantially the same movement to a respective tool bit and further tool bit, though, e.g. out of phase with one another, e.g. 90° or 180° out of phase.

Alternatively in the one version and the another version the at least one cam follower means and the at least one further cam follower means may be different, e.g. in size, though, e.g. provided rotationally separate from one another. In this way the at least one cam follower means and further at least one cam follower means may, in use, impart different movements to a respective tool bit and further tool bit. By such arrangement, in use, the tool bit may impact or work upon a work surface in one way and the further tool bit impact or work upon the work surface in another way.

In the another version the at least one cam track and the another at least one cam track may be substantially different. The at least one cam follower means and at least one further cam follower means may be rotationally separate or coincident. Further the at least one cam track and the another at least one cam track and the another at least one cam track may be in phase or out of phase with one another. By such arrangement, in use, a tool bit of the at least one cam follower means and tool bit of the at least one further cam follower means may be caused to move in a different fashion or manner, whether out of phase or in phase with one another.

It will be appreciated that the embodiments of the present invention hereinbefore described are given by way of example only, and are not meant to be limiting to the scope of the invention. As a non-limiting example the first degree of motion (longitudinal throw) of a tool bit of a tool of the present invention may typically operate at a frequency of the order of 5,000 to 10,000 cycles per minute. The second degree of motion (chatter)—if present—of the cam follower means and therefore of the tool bit typically may be of the order of 10 to 20 times the frequency of the first degree of motion.

The invention claimed is:

1. A tool comprising a cam track, a cam follower and a tool bit, wherein the cam track comprises a first cam track wall means and a second cam track wall means, the cam follower comprises a first cam follower wall means and a second cam follower wall means, and the first cam track wall means and first cam follower wall means face one another, and the second cam track wall means and second cam follower wall means face one another, and further the first cam track wall means comprises a first cam track wave, the first cam follower wall means comprises a first cam follower wave, the second cam track wall means comprises a second cam track wave, and the second cam follower wall means comprises a second cam follower wave.

2. A tool as claimed in claim 1, wherein, in use, the first cam track wall means and first cam follower wall means selectively abut, strike, ride over or upon, slide relative to, and/or contact one another.

3. A tool as claimed in claim 1, wherein, in use, the first cam track wall means and first cam follower wall means interact with, co-act or ride upon one another such that at least part of a motion of the cam track defines or determines at least part of a motion of the cam follower or vice versa.

4. A tool as claimed in claim 1 wherein the first and second cam track wall means are disposed so as to face one another.

5. A tool as claimed in claim 1 wherein the first and second cam follower wall means are disposed so as to oppose one another, such as back to back.

6. A tool as claimed in claim 1, wherein the cam follower means is provided within the cam track, such as between the first and second cam track wall means.

7. A tool as claimed in claim 1, wherein, in use, the second cam track wall means and the second cam follower wall means selectively abut, strike, ride over or upon slide relative to and/or contact one another.

8. A tool as claimed in claim 7, wherein the second cam track wall means and second cam follower wall means interact with, co-act, or ride upon one another such that at least a further part of a motion of the cam track defines at least a part or a further part of a motion of the cam follower or vice versa.

9. A tool as claimed in claim 1, wherein the first cam track wall means is rotationally or circumferentially continuous.

10. A tool as claimed in claim 1, wherein the first cam track wave comprises a periodic waveform.

11. A tool as claimed in claim 1, wherein the first cam track wave comprises a sinusoidal waveform.

12. A tool as claimed in claim 1, wherein the second cam track wall means is rotationally or circumferentially continuous.

13. A tool as claimed in claim 1, wherein the second cam track wave comprises a periodic waveform.

14. A tool as claimed in claim 1, wherein the second cam track wave comprises a sinusoidal waveform.

15. A tool as claimed in claim 1, wherein the first cam follower wall means is rotationally or circumferentially continuous.

16. A tool as claimed in claim 1, wherein the first cam follower wall means is provided on a plurality of spaced cam follower members, such that each cam follower member defines at least part of the first and/or second cam follower walls and/or waves or waveforms.

17. A tool as claimed in claim 1, wherein the first cam follower wall means comprises or defines a periodic waveform.

18. A tool as claimed in claim 1, wherein the first cam follower wall means comprises or defines a sinusoidal waveform.

19. A tool as claimed in claim 1, wherein the second cam follower wall means is rotationally or circumferentially continuous.

20. A tool as claimed in claim 1, wherein the second cam follower means is provided on the or a further plurality of spaced cam follower members.

21. A tool as claimed in claim 1, wherein the second cam follower wall means comprises or defines a periodic waveform.

22. A tool as claimed in claim 1, wherein the second cam follower wall means comprises or defines a sinusoidal waveform.

23. A tool as claimed in claim 1, wherein the cam follower comprises at least first and second parts assembled to provide a rotationally or circumferentially continuous cam follower.

24. A tool as claimed in claim 1, wherein a longitudinal distance between a peak of the first cam track wave and a peak of the second cam track wave is less than a longitudinal distance between a peak of the first cam follower wave and a peak of the second cam follower wave.

25. A tool as claimed in claim 1, wherein a period or frequency of the first and the second cam track waves and the first and the second cam follower waves are substantially the same.

26. A tool as claimed in claim 1, wherein the amplitude of the first cam track waveform and the first cam follower waveform are substantially the same.

27. A tool as claimed in claim 1, wherein the amplitude of the second cam track waveform and the second cam follower waveform are substantially the same.

28. A tool as claimed in claim 1, wherein the amplitude of the first cam track waveform and the second cam track waveform are substantially the same.

29. A tool as claimed in claim 1, wherein peaks of the first and the second cam track waveforms are circumferentially or radially coincident or longitudinally face one another.

30. A tool as claimed in claim 1, wherein troughs of the first and the second cam follower waveforms are circumferentially or radially coincident or longitudinally oppose one another.

31. A tool as claimed in claim 1, wherein peaks of the first and the second cam track waveforms are circumferentially or radially coincident or longitudinally oppose one another.

32. A tool as claimed in claim 1, wherein troughs of the first and the second cam follower waveforms are circumferentially or radially coincident or longitudinally oppose one another.

33. A tool as claimed in claim 1, wherein a longitudinal distance between peaks of the first and the second cam track walls is less than a longitudinal distance between peaks of the first and second cam follower walls.

34. A tool as claimed in claim 1, wherein the cam track is provided circumferentially on a cam cylinder.

35. A tool as claimed in claim 1, wherein there are provided rotary drive means for rotarily driving the cam track, rotary motion of the cam track being, in use, being converted into reciprocal or longitudinal motion of the cam follower means.

36. A tool as claimed in claim 1, wherein there are provided rotary drive means for rotarily driving the cam follower means, the rotary motion of the cam follower means being converted into reciprocal or longitudinal motion of the cam track.

37. A tool as claimed in claim 1, wherein there is provided reciprocal or longitudinal drive means for reciprocally driving the cam track, the reciprocal motion of the cam track being converted into rotary motion of the cam follower means.

38. A tool as claimed in claim 1, wherein there is provided reciprocal or longitudinal drive means for reciprocally driving the cam follower means, the longitudinal motion of the cam follower means being converted into rotary motion of the cam tack.

39. A tool as claimed in claim 1, wherein the cam track is made from a metallic material, such as phosphor bronze.

40. A tool as claimed in claim 1, wherein the cam follower means is made from a metallic material, such as phosphor bronze.

41. A tool as claimed in claim 1, wherein a width of at least a portion of the cam track is greater than a width of at least a portion of the cam follower means, the cam follower means and cam track optionally being a loose fit relative to one another.

42. A tool as claimed in claim 1, wherein the cam track and cam follower means are engaged with one another.

43. A tool as claimed in claim 1, wherein the cam follower means is engaged within or located in the cam track.

44. A tool as claimed in claim 1, wherein the cam follower means is adapted to run in the cam track, such, in use, as move around the cam track and be thrown between opposing first and second cam wall means of the cam track.

45. A tool as claimed in claim 1, wherein a width of at least a portion of the cam follower means is less than 90%, 80%, 70%, 60%, or 50% of a width of at least a portion of the cam track.

46. A tool as claimed in claim 1, wherein the width of the cam follower means is in the region of 10% to 90%, or 40% to 80% of the width of the at least a portion of the cam track.

47. A tool as claimed in claim 1, wherein in use, when not placed against a work surface the cam follower means follows a path dictated substantially only by the cam track.

48. A tool as claimed in claim 1, wherein the cam track and cam follower means are such that, in use, when not placed against a work surface the cam follower means travels in a path from one portion on one wall means of the cam track to another portion on another wall means of the cam track, optionally without intermediately striking the wall means of the cam track.

49. A tool as claimed in claim 1, wherein in use, when placed against a work surface the cam follower means follow a path dictated by the cam track and by ricochet of the tool off the work surface and/or the cam follower means off the first and/or the second wall means of the cam track.

50. A tool as claimed in claim 49, wherein, in use the cam follower means has two degrees of motion, a first degree of motion defined by the cam track, and a second degree of motion defined by ricochet between opposing wall means of the cam track.

51. A tool as claimed in claim 50, wherein the first degree of motion has a frequency defined by the cam track.

52. A tool as claimed in claim 51, wherein the second degree of motion has a higher frequency than the frequency of the first degree of motion, the frequency of the second degree of motion varying dependent upon the work surface to which the tool is presented.

53. A tool as claimed in claim 50, wherein the first degree of motion causes a substantially longitudinal throw of a tool bit of the tool.

54. A tool as claimed in claim 50, wherein the second degree of motion causes a substantially longitudinal vibration or chatter of the tool bit of the tool.

55. A tool as claimed in claim 1, wherein a width of at least a portion of the cam follower means is less than a width of at least a portion of the cam track.

56. A tool as claimed in claim 1, wherein the cam track comprises a closed or circular track, and is provided on a cam cylinder, the width of the cam track optionally being constant or varying around the length thereof.

57. A tool as claimed in claim 1, wherein the cam follower comprises a closed or circular member or members, the width of the cam follower being constant or varying around the length thereof.

58. A tool as claimed in claim 1, wherein the cam track is recessed and the cam follower means received therein, or the cam follower means is recessed and the cam track received therein.

59. A tool as claimed in claim 1, wherein the tool is a power tool or hand-held tool, such as a hand-held power tool.

60. A tool as claimed in claim 1, wherein the tool is powered by an: external electrical supply, such as alternating current or direct current, mains electricity (110V/240V AC); by a low voltage supply (12V DC), such as from a motor vehicle or automotive vehicle or vessel/boat; or by one or more batteries.

61. A tool as claimed in claim 1, wherein the cam track or the cam follower means is rotationally driven by rotational drive means, optionally an electric motor.

62. A tool as claimed in claim 1, wherein the tool comprises a marine tool, underwater tool, or marine growth removal or anti-fouling tool, such as a barnacle scraper.

63. A tool as claimed in claim 1, wherein the tool comprises a housing, a drive means and a mounting arrangement for a tool bit, wherein there is provided within the housing an output arrangement adapted to drive an output shaft in a reciprocal axial movement to drive the tool bit, and the drive means is substantially sealed such as against fluid ingress, from external of the tool.

64. A tool as claimed in claim 1, wherein the tool comprises a handyman's or tradesman's tool.

65. A tool as claimed in claim 1, wherein the tool comprises a scraper, paint stripper, wallpaper stripper, chisel, cold chisel, power spade, hammer or the like.

66. A tool as claimed in claim 1, wherein the tool comprises a down hole tool.

67. A tool as claimed in claim 1, wherein the tool comprises one or more of:

a housing;

a rotary drive means, such as electric motor;

a cylinder cam having the cam track extending around a circumferential surface thereof;

a mounting arrangement for a tool bit, one of the cam track and cam follower means being driven by the drive means;

the mounting arrangement being associated with one of the cam track and the cam follower means, such that actuation of the rotary drive means drives reciprocal movement of the mounting arrangement;

at least part of the cam track being in the form of a wave having an amplitude and a wavelength, the wave having a forward throw section, and a rearward throw section, which, in use, drive the mounting arrangement respectively forward and rearward.

68. A tool as claimed in claim 1, wherein there is provided a plurality of interchangeable tool bits.

69. A tool as claimed in claim 1, wherein reciprocal or longitudinal motion of the cam follower means or cam track causes reciprocal or longitudinal motion of the tool bit.

70. A tool as claimed claim 1 wherein peaks of the first cam track wall means are circumferentially coincident with peaks of the second cam track wall means, troughs of the first cam track wall means are circumferentially coincident with troughs of the second cam track wall means, peaks of the first cam follower wall means are circumferentially coincident with peaks of the second cam follower wall means, and troughs of the first cam follower wall means are circumferentially coincident with troughs of the second cam follower wall means.

* * * * *